US005648008A

United States Patent [19]

Barritt et al.

[11] Patent Number: 5,648,008

[45] Date of Patent: Jul. 15, 1997

[54] INDUCTIVE COOKING RANGE AND COOKTOP

[75] Inventors: William D. Barritt, Greenfield, Ind.; Jong Hak Lee, Koyang, Rep. of Korea

[73] Assignee: Maytag Corporation, Newton, Iowa

[21] Appl. No.: 344,505

[22] Filed: Nov. 23, 1994

[51] Int. Cl.[6] ..... H05B 6/08; H05B 6/12

[52] U.S. Cl. ..... 219/626; 219/627; 219/661; 219/667; 219/665; 363/49; 363/21

[58] Field of Search ..... 219/620, 625, 219/626, 627, 661, 663, 664, 665, 667; 363/49, 21

[56] References Cited

U.S. PATENT DOCUMENTS

| | | | |
|---|---|---|---|
| 3,953,783 | 4/1976 | Peters, Jr. | 321/43 |
| 3,978,307 | 8/1976 | Amagami et al. | 219/10.77 |
| 4,015,084 | 3/1977 | Tsumori et al. | 219/10.49 |
| 4,016,392 | 4/1977 | Kobayashi et al. | 219/10.49 |
| 4,065,802 | 12/1977 | Mizukawa et al. | 361/18 |
| 4,085,300 | 4/1978 | MacKenzie et al. | 219/10.49 |
| 4,115,676 | 9/1978 | Higuchi et al. | 219/10.49 |
| 4,209,683 | 6/1980 | Kiuchi et al. | 219/10.77 |
| 4,308,443 | 12/1981 | Tucker et al. | 219/10.49 R |
| 4,352,000 | 9/1982 | Fujishima et al. | 219/10.77 |
| 4,356,371 | 10/1982 | Kiuchi et al. | 219/10.77 |
| 4,429,205 | 1/1984 | Cox | 219/10.77 |
| 4,453,068 | 6/1984 | Tucker et al. | 219/10.77 |
| 4,456,807 | 6/1984 | Ogino et al. | 219/626 |
| 4,467,165 | 8/1984 | Kiuchi et al. | 219/10.77 |
| 4,511,781 | 4/1985 | Tucker et al. | 219/10.77 |
| 4,540,866 | 9/1985 | Okuda | 219/10.77 |
| 4,600,823 | 7/1986 | Hiejima | 219/10.77 |
| 4,617,442 | 10/1986 | Okuda | 219/10.77 |
| 4,686,340 | 8/1987 | Fukasawa | 219/10.77 |
| 4,701,588 | 10/1987 | Fukasawa | 219/10.77 |
| 4,736,082 | 4/1988 | Matsuo et al. | 219/10.77 |
| 4,757,176 | 7/1988 | Suzuki et al. | 219/10.77 |
| 4,757,177 | 7/1988 | Suzuki et al. | 219/10.77 |
| 4,810,847 | 3/1989 | Ito | 219/10.77 |
| 4,820,891 | 4/1989 | Tanaka et al. | 219/10.77 |
| 4,900,884 | 2/1990 | Aoki | 219/626 |
| 4,908,489 | 3/1990 | Panecki et al. | 219/10.77 |
| 5,111,014 | 5/1992 | Tanaka et al. | 219/10.77 |
| 5,204,504 | 4/1993 | Tanaka | 219/10.55 B |
| 5,248,866 | 9/1993 | Tanaka et al. | 219/10.77 |
| 5,324,906 | 6/1994 | Dong | 219/626 |
| 5,376,775 | 12/1994 | Lee | 219/665 |
| 5,450,305 | 9/1995 | Boys et al. | 219/664 |

*Primary Examiner*—Philip H. Leung
*Attorney, Agent, or Firm*—Brinks Hofer Gilson & Lione

[57] ABSTRACT

An induction cooking apparatus and method for inductively heating cookware is provided. An analog/digital circuit, including a microprocessor, generates a plurality of gating pulses for operating the power inverter circuit and monitors the operation of the power inverter circuit. The microprocessor provides signals to start and stop the inverter circuit, and determines a period of uninterrupted power inverter circuit operation corresponding to a desired cooking temperature. Analog circuitry is provided for sustaining operation of the power inverter circuit after the power inverter circuit is started, and for compensating for variations in cookware materials.

49 Claims, 17 Drawing Sheets

120 Hz POWER LINE
HALF CYCLE
2ms
4.15ms
8.3ms
0.45ms

INPUT TO MICROPROCESSOR 54
FROM ZERO CROSSING DETECTOR 76

"START" PULSE

OUTPUT OF GATE
GENERATOR 86

1.35ms
"BREAK" OUTPUT

VOLTAGE ACROSS POWER INVERTER
TRANSISTOR 44

MICROPROCESSOR OUTPUT TO BASE
OF TRANSISTOR 104 OF PAN
DETECTOR 82

VOLTAGE AT BASE OF TRANSISTOR 110
OF PAN DETECTOR 82

VOLTAGE ACROSS CAPACITOR 102 OF
PAN DETECTOR 82
1.35ms

N: COUNT OF NUMBER OF POWER LINE HALF-CYCLES

D: MAXIMUM NUMBER OF POWER LINE HALF-CYCLES 16
40
78
12
10
F
92
C9
Vcc
109
43
C4
42
C10
45
44
D9
Q1
K
R16
94
R18
22
R21
R25
Vcc
C11
R32
R29
46
R33
R22
R24
82
R17
D6
100
C12
R23
Vcc
80
Vcc
96
Q4
D6
R37
R38
108
R14
106
R26
R36
+5V
R34
Q3
R19
+5V
90
R35
C15
D7
C14
R27
Q5
104
110
66
R50
88
+5V
160
102
112
R20
LIMIT
R13
L
C13
PAN /
R28
Q6
NOPAN
R15
56
PHASE
R51
67
114
WINDOW
BREAK
60
158
144
156
C17
D10
G
Z.XING
58
146
M
R7
64
START
H
DUTY
C25
C18
D11
R11
CTRL
C8
U1
R45
R44
N
63
XC1
C26
136
54
62
Vcc
I
DUTY
SOFT
138
START
59
D
+5V
162
R52
J
Q10
BUZZER
R49
Q12
C21
R54
C29

INDUCTIVE COOKING RANGE AND COOKTOP

FIELD OF THE INVENTION

The present invention relates to an induction heating system, and more particularly, to an induction cooking apparatus with combined analog and digital circuits for controlling the apparatus depending on the presence and type of cookware and desired temperature.

BACKGROUND OF THE INVENTION

Induction cooking devices, such as range cooktops, include a resonant power inverter circuit having an induction heating coil, commonly called a work coil, for receiving a high-frequency current, which in turn generates a high-frequency magnetic field coupled to cookware of metallic material to induce electric current therein for heating the cookware, and any contained food. In using such devices the cookware, such as a pan, is placed on a cooking surface of the range cooktop adjacent to the work coil. The high-frequency magnetic field induces eddy-currents in the metallic body of the cookware. Heat is generated in the body of the cookware as an eddy-current loss, due to the electrical resistance of the material of the cookware opposing the induced eddy-currents. Thus, it is desirable to use cookware made of magnetic metals with high electrical resistance. For this reason, the preferred cookware for induction heated cooking is generally made of materials such as iron or stainless steel.

When the cookware is not present on or is removed from the induction cooking apparatus during or after the cooking operation, the work coil loses its coupled load, referred to as a non-load state. With no load, the input impedance of the resonant circuit is enormously decreased, so that the high-frequency current in the resonant circuit greatly increases, frequently to destructive levels. This phenomenon has been used to determine the presence or absence of cookware on the induction cooking device, by sensing the high-frequency current with a current transformer. When the sensed current exceeds a predetermined value, a prescribed control circuit de-activates the power inverter circuit. As a result, the induction cooking device is protected from an erroneous and possibly destructive operation in the non-load state.

In addition, other approaches in protecting the power inverter circuit have been taken for detecting an unsuitable load on the power invention circuit in an inductive heating apparatus. For example, U.S. Pat. No. 4,356,371 discloses an inductive heating apparatus having a detection circuit which compares the input and output parameters of the inverter and latches a bistable device when the input power parameter is smaller than the output parameter, whereby the bistable device shuts down the inverter to prevent small objects from being overheated. Also, U.S. Pat. No. 4,686,340 discloses an inductive heating apparatus having a detecting circuit for detecting an input AC power and an excitation current for an inverter, so that the levels thereof are compared to discriminate whether or not a load is suitable.

Some approaches of protecting the power inverter circuit not only detect variations in the load, but also compensate for such variations. For example, U.S. Pat. No. 4,820,891 discloses a control circuit for controlling an inductive heating device in response to an impedance detection circuit and an inverter frequency detection circuit. Also, U.S. Pat. No. 4,115,676, uses a current transformer to sense the current flowing through a work coil, and provides a corresponding output as an input to control circuitry which controls the conductance of a power inverter switching transistor in accordance with the magnitude and direction of current flowing through the work coil to compensate for variations in the size, shape, and material of the cookware.

Previously developed induction cook-top devices have not provided adequate control systems for controlling the energization, deenergization and variation of heating levels in the induction heating coils of such cooking apparatus. Power inverter circuits in induction heating devices include a switching component which typically must operate at nearly maximum current capacity. In order to prevent early failure of this critical component, precise timing and real time monitoring of the power inverter circuit is required. For example, induction cooking systems are connected to various line power sources, and thus, such systems should exhibit a wide tolerance of these various power sources in which input line voltage may be low, high, temporarily low or high, noisy, or possibly all of the above.

The functions of the electronic circuitry in induction cooking systems are generally two fold. First, a power inverter circuit produces the power to perform the cooking and second, a power control, timing, and monitoring circuit operates the induction system and provides convenient control for a user.

Some induction heating systems, such as that disclosed in U.S. Pat. No. 4,429,205, rely solely on analog circuitry to provide power, control, timing and monitoring of the power inverter circuit. Still other circuits have used both analog and discrete digital components in the power inverter control circuitry, such as for example, U.S. Pat. Nos. 4,115,676; 4,356,371 and 4,617,442. Such induction systems using monitoring and control circuitry fabricated solely from hard-wired discrete components, however, cannot be easily modified to change the operating characteristics of the system, and troubleshooting such systems can be difficult.

Other systems, such as U.S. Pat. Nos. 4,308,443; 4,453,068 and 4,511,781 have relied primarily on a microprocessor to provide power control, timing and monitoring of the power inverter circuitry. Since the advent of microprocessor controls, an accepted design criteria has been to incorporate the power control, timing and monitoring circuitry into a programmable microprocessor device, which is a favorable design from a cost standpoint and for ease of product change. Using a microprocessor to provide for the timing of the power inverter circuit, however, has a significant draw back. Microprocessors are sensitive to powerline fluctuations which can cause program errors and produce random timing outputs. Random timing outputs from the control circuitry will almost inevitably cause semiconductor components of the power inverter circuit to fail. As a result, the reliability of the induction cooking system is seriously compromised. Thus, induction heating systems incorporating microprocessors for generating the critical timing signals to control a power inverter circuit are unsatisfactory for reliable operation and optimum reliability.

Therefore, an improved induction heating apparatus is needed which overcomes these deficiencies in the prior art.

SUMMARY OF THE INVENTION

The present invention is related to an induction cooking apparatus including an electrical power source for providing, from an AC powerline, a DC power signal including a plurality of powerline half cycles. A power inverter circuit is coupled to the electrical power source and includes an L/C network with a work coil coupled to the DC power signal for inducing heating current in metallic cookware. The power inverter circuit includes a switching device for intermittently connecting the L/C network with the DC power signal. The induction cooking apparatus further includes an analog/digital control circuit coupled to the power inverter circuit. The analog/digital circuit includes a user input for selecting a cooking temperature to be generated in the cookware and a digital device for generating a start signal for initiating operation of the power inverter circuit and for generating a stop signal for stopping operation of the power inverter circuit to define a period of operation of the power inverter circuit for generation of the cooking temperature, wherein the digital device is coupled to the user input. The analog/digital circuit further includes an analog circuit including a gate device for generating gating pulses for operation of the power inverter circuit and a feedback device coupled with the work coil for generating trigger signals to sustain generation of the gating pulses by the gate device after the power inverter circuit is started by the digital device.

The invention provides a reliable induction cooking device wherein control functions which do not directly influence the reliability of the cooking system, such as user power control, are programmed into a microprocessor, and wherein the basic power inverter timing circuit is constructed from analog circuitry that is referenced to the line voltage. Since the analog circuitry is "hard wired", no change to its intended function can be produced by transients or line voltage fluctuations. Thus, if the microprocessor section of the circuitry produces random outputs due to fluctuations in line voltage, the analog circuitry will continue to respond with correct timing characteristics to prevent damage to the power inverter circuit.

In preferred embodiments of the invention, the switching device is an insulated gate bipolar transistor coupled to the work coil to intermittently establish conduction of electrical current of a first polarity through the work coil when the insulated gate bipolar transistor is gated by the gating pulses. The timing of the generation of the trigger signals used to sustain generation of the gating pulses is based on a voltage phase shift across the work coil.

The digital device generates the start signal to start gating pulse generation by the gate device at a low voltage of the DC power signal. Also, the digital device generates the stop signal for stopping the analog circuit from generating the trigger signals. Still further, the digital device generates an output for adjusting duration of gating pulses during a start-up period for the power inverter circuit.

The digital device, in response to the user input for selecting a cooking temperature, controls generation of the gating pulses for a selected number of powerline half cycles corresponding to a desired cooking temperature.

The digital device includes a counting device for counting powerline half cycles which occur after the power inverter circuit is started, and the digital device generates a stop signal to interrupt the generation of the gating pulses when a counted number of powerline half cycles equals or exceeds the selected number of powerline half cycles. The digital device further includes a storing device for storing a number of powerline half cycles associated with a maximum cooking temperature generated by the power inverter circuit. The digital device generates a start signal to re-initiate operation of the power inverter circuit after occurrence of the maximum number of powerline half cycles during cooking.

The analog circuit generates a pan-no pan signal related to the current through the work coil, and the digital device generates a window signal for the pan-no pan signal defining a short portion of each powerline half cycle following its zero voltage crossing as a pan checking period. During the window signal, the analog signal generates an input to the digital device used by the digital device to generate a stop signal for the power inverter circuit if no acceptable cookware is present.

The analog/digital circuit further includes a device for detecting the presence of acceptable cookware near the work coil during a first period of a powerline half-cycle of the DC power signal. The device for detecting the presence of acceptable cookware includes a commutating capacitor coupled between the electrical power source and the work coil. The commutating capacitor generates a voltage related to a recovery time for the commutating capacitor when the switching device is OFF. The device for detecting the presence of cookware further includes a device for sampling the voltage corresponding to the recovery time and a cookware detector circuit including a storage capacitor for accumulating a voltage corresponding to the voltage of the commutating capacitor during a plurality of sampling periods. The cookware detector circuit supplies a cookware detector signal to the digital device related to the accumulated voltage, and the digital device compares the cookware detector signal with a predetermined reference value for determining whether acceptable cookware is present near the work coil.

The feedback device further includes a device for providing varying trigger signal durations to the gate device for generating varying duration gating pulses for operation of the power inverter circuit. The device for providing varying trigger signal durations for the gating pulses includes a phase detector circuit, coupled between the work coil and the gate device, for detecting a voltage phase difference across the work coil and generating trigger signals with durations determined from the voltage phase difference.

The analog device further includes a device for adjusting a cooking power output of the power inverter circuit to compensate for variation in cookware materials. The device for adjusting a cooking power output includes a current transformer having a primary coil and a secondary coil, wherein the primary coil is coupled between the electrical power source and the work coil for sensing the amount of current flowing from the source of electrical power when the switching device of the power inverter circuit is ON. The adjusting device further includes a level shift circuit coupled to the secondary coil of the current transformer for rectifying and filtering a voltage received from the secondary coil and producing a DC output used by the gate device to increase the ON time of the switching device when a current sensed by the current transformer decreases, and to decrease the ON time of the switching device when the current sensed by the current transformer increases.

The induction cooking apparatus further includes an over-heat protection device for detecting an over-temperature near the work coil, wherein the over-heat protection device comprises a transistor for establishing an analog ground to stop the gate device from generating gating pulses upon detection of an over-temperature.

The induction cooking apparatus further includes a zero crossing circuit for generating a zero crossing pulse at each occurrence of zero voltage during each powerline half cycle, wherein the zero crossing pulses are coupled to the digital device as an input.

Viewed in another way, the invention relates to an induction cooking apparatus having an inverter circuit comprising a DC power supply for supplying a plurality of DC power half cycles from an AC powerline; an inverter circuit having an induction heating coil connected at one end to the DC power supply; an insulated gate bipolar transistor connected to the other end of the induction heating coil for conducting current of a first polarity through the heating coil; a diode connected in parallel with the transistor for conducting current of an opposite polarity through the induction heating coil; a zero crossing detector for generating zero crossing reference signals of the AC powerline; a microprocessor for supplying an initial inverter start signal to the inverter circuit, wherein the microprocessor receives the zero reference signals from the zero crossing detector, and starts the inverter circuit at a low voltage generated by the DC power supply, selects a number of powerline half cycles of inverter operation corresponding to a user-desired cooking temperature, and generates signals to interrupt operation of the inverter circuit to obtain the user-desired cooking temperature and to prevent unacceptable operation. An analog circuit referenced to a voltage of the DC power supply is used for sensing the presence of cookware made of proper material, and for generating timing signals for sustaining compensated acceptable operation of the inverter circuit after the inverter circuit is started by the microprocessor.

In preferred embodiments of the invention, the analog circuit includes a phase detector including a phase comparator circuit with one input resistively connected to the collector of the insulated gate bipolar transistor and the other input resistively connected to the connection between the DC power supply and the induction heating coil, and has an output related to the phase difference produced by the inductance of the induction heating coil during inverter operation for generating the timing signals. The analog circuit further includes a gate generator having a comparator with a first input coupled to an output of the microprocessor and to the output of the phase detector for starting and sustaining operation of the inverter circuit by switching the insulated gate bipolar transistor.

The analog circuit further includes a current transformer having a primary winding connected in series with the DC power supply, and having a secondary winding; a rectifier/filter, coupled to the secondary to produce a DC voltage signal related to the amount of current flowing from the DC power supply through the induction heating coil; and a bias control device coupled to the rectifier/filter and to a second input of the gate generator comparator for receiving the DC voltage signal to generate an offset bias voltage at the second input of the gate generator comparator corresponding to an amount of current flowing from the DC power supply through the induction heating coil, wherein the offset bias voltage adjusts operation of the gate generator comparator and conduction time of the insulated gate bipolar transistor to adjust power supplied to the cookware based on a material from which the cookware is made.

The analog circuit further includes a pan detection circuit connected between the inverter circuit and the DC power supply, and connected to the microprocessor, for generating a signal corresponding to a recovery time for the DC power supply during a period of non-conduction of the insulated gate bipolar transistor.

The analog circuit further includes a pan detection circuit coupled to the output of the DC power supply, the phase detector and the microprocessor. A commutating capacitor is coupled to the output of the DC power supply, and the commutating capacitor generates a voltage related to the recovery time for the DC power supply. The microprocessor device and the phase detector supply signals to the pan detector circuit for selectively sampling the signal related to the recovery time. The pan detector circuit includes a storage capacitor for accumulating a voltage corresponding to the voltage of the commutating capacitor during a plurality of sampling periods. The pan detector circuit supplies the accumulated voltage as a pan detector output to the microprocessor device and the microprocessor compares the pan detector output to a predetermined reference value for determining whether acceptable cookware is present near the induction heating coil.

Viewed in still another way, the invention relates to a method for heating metallic cookware with a work coil of an inductive heating device, including the steps of generating a plurality of gating pulses for operating a power inverter circuit wherein a start pulse is generated by digital circuitry and subsequent pulses are generated by analog circuitry; starting the power inverter circuit at zero applied voltages of powerline half cycles; adjusting pulse durations of a plurality of gating pulses during a start period to start the power inverter circuit at reduced power; determining during an initial portion of each powerline half cycle whether acceptable cookware is positioned near the work coil, wherein if after the first initial portion it is determined that acceptable cookware is present, then the power inverter circuit is operated through a remainder of the half cycle, and wherein if at the end of the first initial portion it is determined that no acceptable cookware is present, then the power inverter is commanded by the digital circuitry to stop; and adjusting pulse durations of the gating pulses supplied to the power inverter to compensate for cookware materials other than that of a predetermined standard for the cookware material.

In the preferred methods of the invention, during the initial portion of each powerline half cycle a signal for determining the absence of acceptable cookware is generated, and during a plurality of power inverter cycles corresponding to the periods when gating signals are absent from the voltage applied to the work coil. The method further includes the step of selecting a number of powerline half cycles of operation of the power inverter circuit corresponding to a desired cookware temperature during which the power inverter circuit will run uninterrupted. The method further includes the step of interrupting the generation of the gating pulses by the analog circuitry to temporarily stop the power inverter circuit when an actual number of powerline half cycles is greater than a selected number of powerline half cycles. The method further includes the step of restarting the power inverter circuit following a predetermined number of powerline half cycles corresponding to a maximum cookware temperature.

Viewed in still another way, the invention is related to a cooking range having an induction heating burner connectable to any AC powerline including an inverter circuit for induction heating of a cooking utensil and having a control circuit providing a range user with control of the induction burner, including the temperature generated by the cooking utensil, wherein the improvement includes a digital control portion in communication with the range user providing a signal to start the inverter circuit with an initially reduced power output, a signal to interrupt operation of the inverter circuit in response to the absence of acceptable cookware at the burner, and signals to interrupt operation of the inverter circuit for variable intermittent times to control the temperature generated by the cookware and thereafter restart the inverter circuit during cooking, and an analog control portion generating triggering signals for continuous operation of the inverter circuit once started and in the absence of the interrupting signals from the digital control portion, and signals to compensate for cookware made of materials with differing electromagnetic properties during cooking and to interrupt, through the digital control portion, operation of the inverter circuit if no acceptable cookware is present at the burner.

Preferably, the digital control portion includes a programmed microprocessor having as inputs a signal generated at each zero voltage occurrence by the AC powerline, a signal related to the user-selected cookware temperature, a signal from the analog circuit portion indicating the absence of acceptable cookware, and a signal at each cycle of operation of the inverter circuit. The microprocessor provides in response thereto, a soft start output for initiating operation of the inverter circuit by the analog circuit at reduced power, a window signal for a small initial portion of each powerline half cycle to permit application of the analog circuit signal if no acceptable cookware is present at the burner assembly, break signals to interrupt operation of the inverter circuit following a programmed number of powerline half cycles corresponding to the user-selected cookware temperature and to interrupt operation of the inverter circuit at any time acceptable cookware is not present at the burner, and start signals to restart the inverter circuit, after its interruption at the programmed number of powerline half cycles corresponding to the user-selected cookware temperature, at a number of powerline half cycles corresponding to a maximum user-selectable temperature. The analog circuit portion includes, a generator for gating pulses for operation of the inverter circuit, a detector circuit connected with the inverter circuit for generation of triggering signals for the generation of gating pulses, a compensator circuit coupled with the inverter circuit and providing a compensator signal to the generator for gating pulses that adjust a gating pulse duration for differing cookware materials, and a switch across the output of the generator for gating pulses to interrupt operation of the inverter circuit in response to outputs of the microprocessor.

The cooking range further includes an oven temperature sensor adjacent the burner and an overheat detection circuit to remove application of the triggering pulses from the generator for gating pulses and terminate operation of the inverter circuit in the event of burner overheating. The overheat detection circuit provides an input to the microprocessor, and the microprocessor generates therefrom a warning signal to warn the range user.

Viewed in still another way, the invention relates to an induction cooking apparatus, including a DC voltage source of a filtered plurality of AC powerline half cycles, a power inverter including an induction heating coil, a semiconductor switch providing, upon operation, an electric current path from the DC voltage source through the induction heating coil, and a control for switching the semiconductor switch ON and OFF to provide induction heating of cookware adjacent the induction heating coil, wherein the improvement includes a capacitor connected across the DC voltage source at the input of the induction heating coil, a pan-present circuit connected with the capacitor and generating a no pan voltage from the voltage of the capacitor, including a first window device for the no pan voltage, permitting generation of the no pan voltage for only a small initial portion of each powerline half cycle following each zero voltage event, a second window device permitting generation of the no pan voltage only during the OFF periods of the semiconductor switch, and an integrator to accumulate the no pan voltage only during a plurality of semiconductor switch OFF periods in the small initial portions of each powerline half cycle, the no pan voltage being thereby generated from recovery of the DC voltage source from electric current through the inductor heating coil and being applied to the control to interrupt operation of the semiconductor switch.

Viewed in still another way, the invention relates to an induction cooking apparatus including a DC power supply, a power inverter including an induction heating work coil and a semiconductor switch providing upon operation a path for electric current from the DC power supply through the inductor heating work coil, and a control for operating the semiconductor switch to provide current pulses to generate a high frequency electromagnetic field with the induction heating work coil and to induce electric currents in cookware. The induction cooking apparatus further includes a cookware compensation circuit, including, a current transformer having its primary coil connected to conduct electric current from the DC power supply as a result of operation of the induction heating work coil and having a secondary coil connected with a rectifier-filter circuit to generate a DC voltage corresponding to the electric current resulting from operation of the induction heating work coil, a switching time controller in the control for varying the duration of the current pulses provided from the semiconductor switch, and a coupler for the DC voltage to decrease the duration of the current pulses from the semiconductor switch as the electric current resulting from operation of the induction coil increases and to increase the duration of the current pulses from the semiconductor switch as the electric current from operation of the induction coil decreases to thereby compensate for the electromagnetic properties of the material of the cookware used with the apparatus.

Viewed in still another way, the invention relates to an induction cooking apparatus including a DC power supply, a power inverter circuit including an induction heating coil and a switching circuit for providing electric current pulses from the DC power supply through the induction heating coil, and a control for operating the switching circuit and for generating with the coil induction heating coil an induction heating field, an improvement wherein the switching circuit for the induction heating coil is an insulated gate bipolar transistor, and wherein any control analog circuitry connected with the induction heating coil to generate, once started, operating signals of variable duration for the insulated gate bipolar transistor.

The analog circuitry includes a phase comparator having one input connected with one end of the induction heating coil and the other input connected with the other end of the induction heating coil to provide an output only when the one end is at a voltage less than the other end, the output providing a variable duration operating signal for controlling the insulated gate bipolar transistor.

The induction cooking apparatus further includes a temperature sensor, is located adjacent the induction heating coil for providing, in the event of unacceptable temperatures, an output to interrupt the operating signals of the analog circuitry to stop operation of the induction heating coil. The induction cooking apparatus further includes a pan detection circuit for determining the presence of acceptable cookware adjacent the induction heating coil from the recharging rate of the DC power supply and wherein the operation signals of the analog circuitry gates the pan detection circuit so that it only receives recharging rate signals.

Other features and advantages of the invention may be determined from the drawings and the detailed description of the invention that follows.

DETAILED DESCRIPTION OF THE PREFERRED EMBODIMENTS

Figure 1:
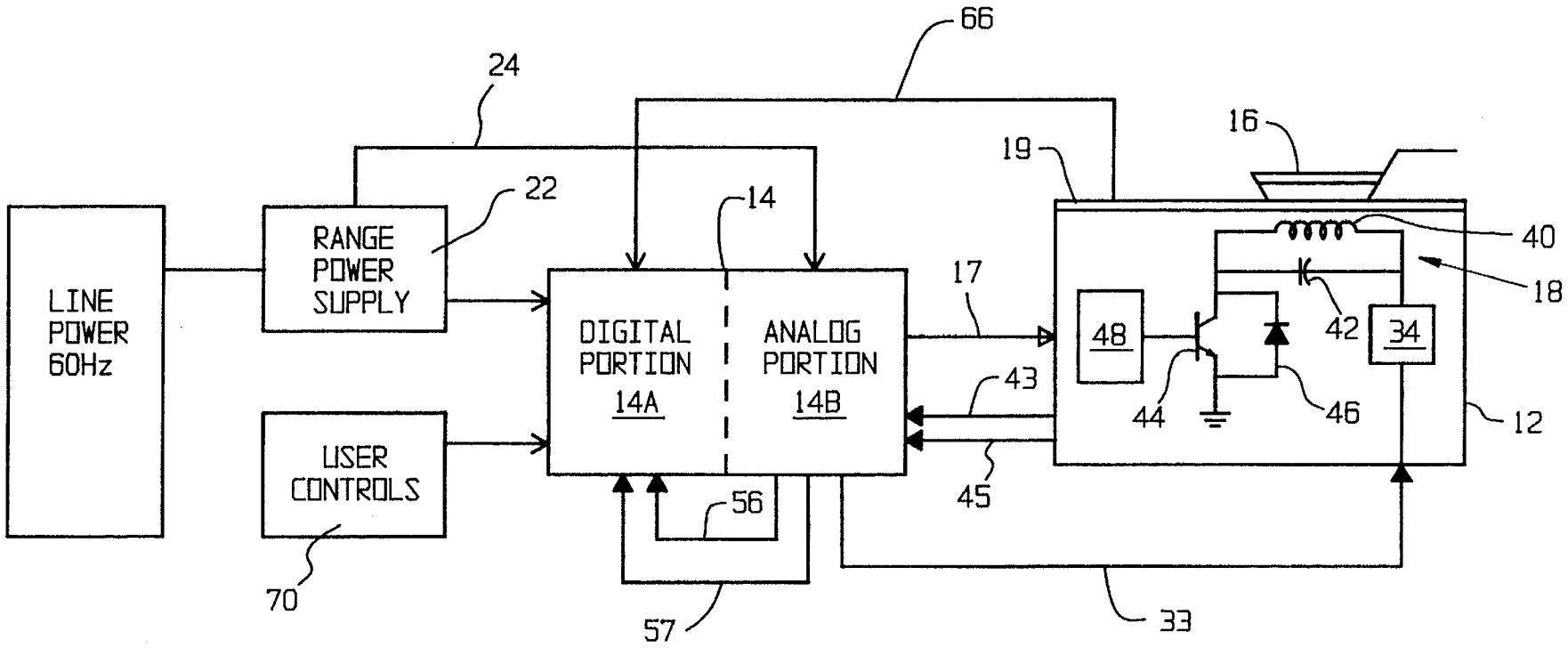
FIG. 1 shows generally a block representation of an inductive cooking system embodying the invention.

FIG. 1 shows an inductive cooking system 10 embodying the invention. System 10 includes a power inverter circuit 12 and a control subsystem 14. Power inverter circuit 12 generates a high frequency (about 20 k Hz) electromagnetic field for heating metallic cookware 16, such as a pan, in response to signals from monitoring and gating circuitry in control subsystem 14.

When the inductive cooking system 10 is "ON", control subsystem 14 delivers a series of driving pulses via a conductor 17 to power inverter circuit 12, which in turn produces inductive heating of pan 16 by generating an electromagnetic field oscillating at a frequency varying around about 20 kHz. A resonant tuned inductor/capacitor (L/C) circuit 18 includes a cooking inductor 40, commonly called a work coil, which is the source of the electromagnetic field. A cooking location ("burner") is indicated adjacent the work coil on a glass range top 19. Cookware 16 is inductively coupled to the work coil 40 of L/C circuit 18 by placing cookware 16 on the "burner" location on the glass cooktop 19, and generates heat to cook its contents through the resistive power loss from the electric current induced in the cookware 16 by the 20 kHz electromagnetic field from work coil 40. The driving pulses supplied to power inverter 12 by control subsystem 14 repeatedly close and open a circuit path through the L/C circuit 18 by operation of inverter circuit switching device 44 and its driver 48 to generate the about 20 kHz cooking power output.

Control subsystem 14 combines both digital and analog subsystems which control and monitor power inverter circuit 12.

The digital portion of control subsystem 14 is in communication with the user of the range and generates and delivers operating signals (a) to start operation of the power inverter subsystem 12, (b) to control the power inverter subsystem 12 to generate the heating of the cookware 16 requested by the user and (c) to interrupt operation of the power inverter subsystem if cookware is not adjacent the work coil 14 or is removed therefrom, if the range surface is over heating, and when the range is turned off by the user. The digital portion 14A provides through a programmed microprocessor, control based on user inputs and protection against user in-attention.

The analog portion 14B of control subsystem 14 automatically (a) generates a pan/no pan signal, (b) generates driving signals for the power inverter subsystem 12, (c) generates a monitoring signal for digital control portion 14A, and (d) compensates for phase shifts in the power inverter subsystem due to the varying electrical and magnetic properties of different cookware materials. The analog portion 14B of control subsystem 14 provides increased flexibility and control of work coil operation through the use of an insulated gate bipolar transistor (IGBT) for its switching device 44, provides reliable operation of the insulated gate bipolar transistor switching device 44 and of work coil 40 in the presence of low and varying power company voltages, and protects the power inverter circuit 12 from spurious signals of the type that can be generated with digital circuitry under such conditions.

Thus, the digital portion 14A of control subsystem 14 provides the user interface and, after commencing operation of the power inverter circuit, can only interrupt its operation to turn off the range and reduce the heat generated in the cookware 16. After being started by the digital portion 14A, the analog portion 14B interacts with the power inverter circuit 12 to continue its operation with hard-wired components that react proportionally to varying applied AC voltage without generation of possibly destructive gating signals for power inverter circuit 12. Thus, the reliability of the resulting range is increased without a loss in flexibility of operation afforded by a software programmed control system.

The control subsystem 14 includes a procedure to protect the range from damage during startup. Following operation of the ON control by the user, control subsystem 14 generates, with digital portion 14A, a "soft" start beginning with the next rise of the applied AC voltage from its next zero voltage event (referred to as "zero crossing") and creating low level initial power generation in work coil 40. The control subsystem 14 also conducts a pan/no pan check during the first few milliseconds of power generation by work coil 40 and, if no pan is present, interrupts operation of power inverter circuit 12 for one second (120 half cycles) and then repeats the soft start, pan check procedure.

If the pan check indicates that a pan is present, control system 14 gradually increases the power generated by work coil 40 which is thereafter controlled by the analog portion 14B of the control, as further explained below, except as interrupted by the digital portion 14A for a variable percentage of each 100 half cycles to effect the user's cooking heat control input.

Control subsystem 14 generates the series of gating signals for operating power inverter circuit 12, wherein a "start" pulse is generated by digital circuitry 14A in response to a user's operation and subsequent pulses are generated by analog circuitry 14B. Upon receiving a command from an operator to begin cooking, control subsystem 14 supplies the series of gating pulses to inverter system 12 for a "pan check" period, preferably about 1.35 mS, and initially starts inverter system 12 at a low line voltage of a rectified 120 Hz powerline signal. Each cycle of the rectified 120 Hz powerline signal is designated hereinafter as a powerline half cycle which corresponds to one-half of the non-rectified 60 Hz AC line voltage having a time duration of about 8.33 mS. Also, control subsystem 14 initially starts power inverter circuit 12 at reduced power by limiting the duration of the gating pulses.

Control subsystem 14 checks whether a proper pan is present at the "burner" location at the beginning of each powerline half cycle of operation. During a "pan check" period, which is preferably the first 1.35 mS of a powerline half-cycle, it is determined whether there is a proper pan coupled to the work coil 40 of inductive cooking system 10. If after the 1.35 mS pan checking period it is determined that a pan 16 of a proper material, such as for example iron or stainless steel, is present then the analog portion 14B of control subsystem 14 will continue to generate drive pulses to continue the operation of power inverter circuit 12 through each powerline half cycle. If, at the end of the 1.35 mS pan check period, it is determined that an improper pan, or no pan, is present, then the digital portion 14A of the control subsystem 14 will interrupt operation of the power inverter 12 after 1.35 mS to protect the components of the power inverter circuit from damage.

During operation, the analog portion 14B of control subsystem 14 adjusts the pulse duration of the gating pulses supplied to power inverter 12 to compensate for pan materials other than a selected pan material standard, which is preferably cast iron. Control subsystem 14 also monitors the temperature at the burner location with its digital portion 14A and monitors phase relationship of voltages within power inverter circuit 12 with both its digital and analog portions.

The cooking temperature selected by the user determines the percentage of the time in which power inverter 12 will generate its electromagnetic field, thereby determining an average power loss in pan 16 and its temperature. The digital portion 14A of the control subsystem 14 is programmed with a number of powerline half cycles associated with maximum cooking power; conveniently, 100 powerline half cycles is used in the range. For example, the operator may select a cooking temperature which requires heat generation by the pan for 80 percent of the time to obtain the desired pan temperature. During operation of the burner, the digital portion 14A of the control counts the number of powerline half cycles during which the power inverter circuit 12 is operated. After 80 half cycles, the digital portion 14A interrupts gate pulse generation by the analog circuitry to temporarily stop power inverter 12 for a period of 20 powerline half cycles. After the brief shut-down period, the digital circuitry 14A restarts power inverter circuit 12, a "pan check" is performed, and if a proper pan remains present, the analog portion 14B continues to generate subsequent gating pulses to sustain the operation of power inverter circuit 12 for another 80 powerline half cycles, unless there is a user adjustment and, the cooking process continues.

Figure 2:
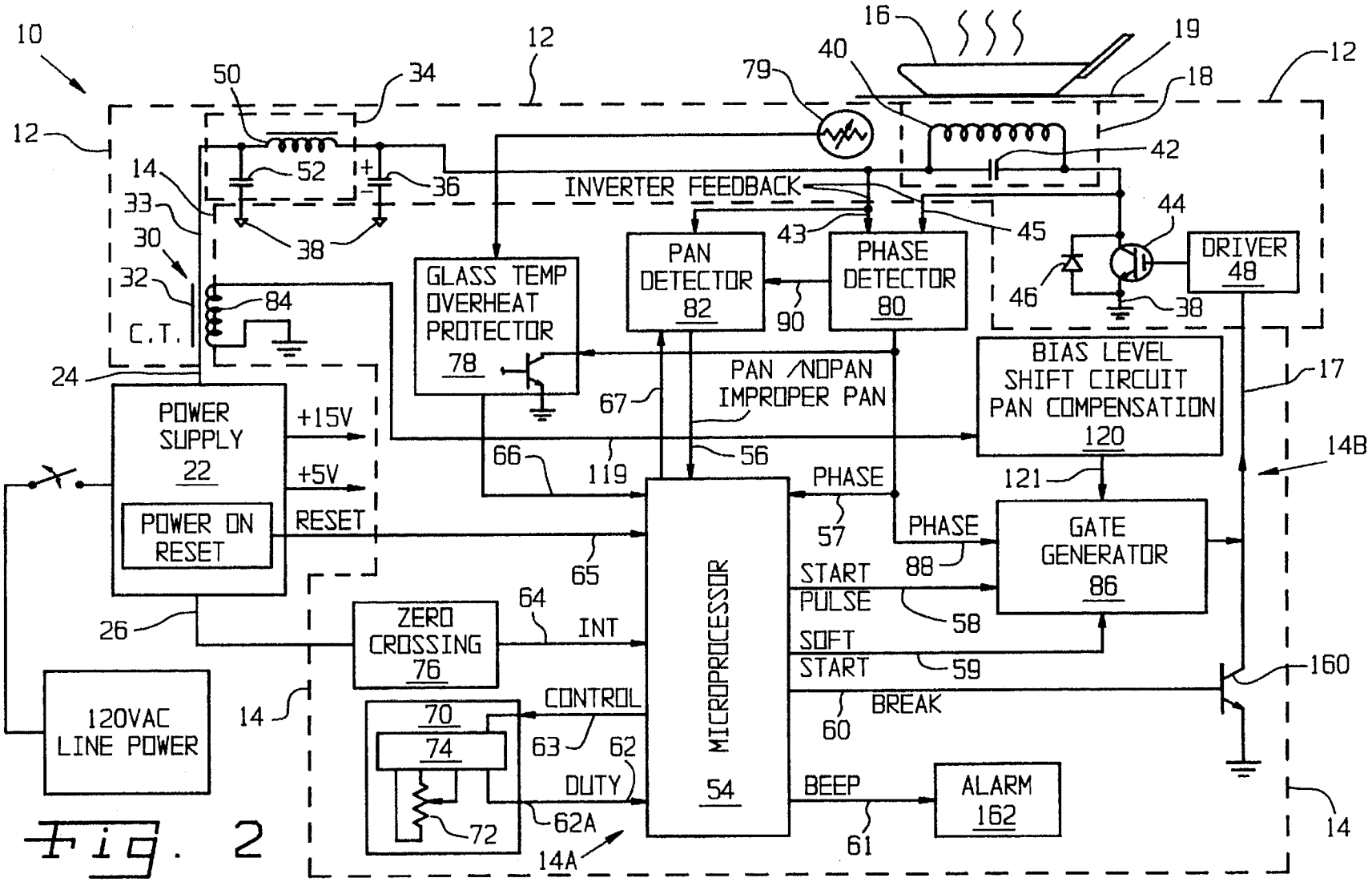
FIG. 2 shows a more detailed block representation of the inductive cooking system of FIG. 1.

As shown in FIG. 2, power inverter circuit 12 and control subsystem 14 receive electrical power from an AC powerline source 20, which is 60 Hz and nominally 110–120 volts, and a power supply 22. Power supply 22 includes an AC noise filter which filters the incoming 60 Hz input voltage prior to being rectified by an internal full wave rectifier. Thus, power supply 22 generates an unregulated DC signal comprising rectified 120 Hz powerline half cycles which is supplied via a conductor 24 to power inverter circuit 12. In addition to supplying a rectified signal to power inverter circuit 12, power supply 22 supplies a signal via conductor 26 and a reset sense signal via conductor 65 and filtered 5 V and 15 V power to control subsystem 14.

Conductor 24, which conducts the rectified 120 Hz voltage pulses, is connected to the power inverter circuit 12 through a primary coil 32 of a current transformer 30 in the analog portion 14A of the control. The primary coil 32 is connected through a main power inverter conductor 33 to an input of a low-pass filter 34. Low-pass filter 34 includes an inductor 50 coupled between current transformer 30 and work coil 40 of L/C circuit 18. A capacitor 52 is coupled between the input of inductor 50 and ground 38. Low-pass filter 34 filters the 120 Hz half cycle voltage pulses from power supply 22 to smooth the DC waveform. The output of low pass filter 34 is coupled to a first terminal (+) of a commutating capacitor 36. A second terminal (–) of capacitor 36 is coupled to ground 38. The power output of low-pass filter 34 is coupled to one terminal of L/C circuit 18, which includes a work coil 40 coupled in parallel with a capacitor 42. The other terminal of the L/C circuit 18 is coupled to a collector of a power inverter switching device 44. As set forth above, the switching device 44 is preferably an insulated gate bipolar transistor (IGBT). An emitter of switching device 44 is coupled to ground 38, and diode 46 is coupled in a reverse bias fashion between the collector and emitter of power inverter transistor 44 to conduct reverse currents generated by L/C circuit 18 when power inverter transistor 44 is switched OFF. A base of power inverter switching device 44 is coupled to an output of a power inverter switch driver circuit 48. An input of power inverter switch driver circuit 48 is coupled via conductor 17 to the analog portion 14B of control subsystem 14.

As noted above, power inverter circuit 12 generates an electromagnetic field having a frequency of about 20 kHz with work coil 40 and capacitor 42 which are resonant at about 20 kHz. (Pan 16 is inductively coupled to the field generated by work coil 40, and thus affects the resonant frequency and inductive impedance of L/C circuit 18.) The cooking power signal supplied to work coil 40 and capacitor 42 is generated by repeatedly closing and opening the circuit path between power supply 22 and ground 38 at the emitter of inverter switching transistor 44 by alternately turning inverter switching transistor 44 ON and OFF via drive signals supplied to the base of inverter switching transistor 44 by power inverter transistor driver circuit 48, which is in turn actuated via gating signals received from the analog portion 14B of control subsystem 14.

The digital and analog portions 14 provide, as noted above, automatic timing and power control for power inverter circuit 12 based upon user inputs and monitored parameters. For example, a user need only tell inductive cooking system 10 the desired cooking temperature and place pan 16 on the "burner" near work coil 40 to begin the cooking process. Thereafter, the system continues to monitor the presence of pan 16 on work coil 40, as well as control the temperature of pan 16. If pan 16 is removed from work coil 40 during the cooking process, or if work coil 40 overheats, then power inverter circuit 12 is automatically turned OFF to protect the power inverter components from damage.

The digital portion 14A of control system 14 is preferably a microprocessor 54 which is coupled to the analog portion 14B of control system 14 via conductors 56–67. Microprocessor 54 is coupled to a user temperature select control 70 via conductors 62, 63. Temperature select control 70 receives user inputs via a potentiometer 72. A cooking temperature level selector 74 is coupled between temperature select control 70 and microprocessor 54. Microprocessor 54 supplies a signal to cooking temperature selector 74 to initiate a cooking temperature check cycle. At this time, the output of cooking temperature selector 74 is "low". Cooking temperature selector 74 responds by slowly increasing an internal reference voltage, which is compared to a cooking temperature reference voltage supplied to cooking temperature level selector 74 by potentiometer 72. When the increasing internal reference voltage is equal to the reference voltage supplied by potentiometer 72, the output of cooking temperature selector 74 goes "high". Microprocessor 54 reads the change in logic level from "low" to "high" at the output of cooking temperature selector 74. Microprocessor 54 then determines the amount of time which expired between the time when microprocessor 54 supplied the signal via line 63 to cooking temperature selector 74, and the time in which the output 62*a* of cooking temperature selector 74 became "high". From this time difference, microprocessor 54 determines the number of powerline half cycles through which power inverter circuit 12 will operate uninterrupted so as to establish and maintain the temperature of cookware 16 at the desired cooking temperature.

Control subsystem 14 monitors the operation of power inverter circuit 12 via a zero crossing detector 76, an overheat protector 78, a phase detector 80, a pan detector 82, and a secondary winding 84 of current transformer 30. Zero crossing detector 76, overheat protector 78, phase detector 80 and pan detector 82 each supply inputs to microprocessor 54 via conductors 64, 66, 57, and 56, respectively. The analog portion 14B of control subsystem 14 includes a gate generator 86 for generating and supplying gating signals to driver 48 of power inverter circuit 12 when started.

As shown in FIG. 2, zero crossing detector 76 is coupled via conductor 26 with power supply 22 for receiving a signal corresponding to the 60 Hz AC power supply output and for generating a zero crossing signal each time the 60 Hz AC power signal is at zero volts. This zero crossing signal is supplied to an input of microprocessor 54 via conductor 64 and is used by microprocessor 54 to start power inverter circuit 12 and to initiate a short time period, hereinafter designated as a "pan check" period, in which microprocessor 54, through outputs of the analog portion 14B, monitors power inverter circuit 12 for the presence of unacceptable conditions such as, for example, the lack of a pan or improper pan material.

FIGS. 3A–3I form a timing diagram representing the relationship of the various signals related to the operation of system 10 during an initial start-up period, including the "pan check" period. FIGS. 3A–3I will be discussed with reference to FIG. 2.

Figures 3A, 3B, 3C, 3D, 3E, 3F, 3G, 3H, 3I:
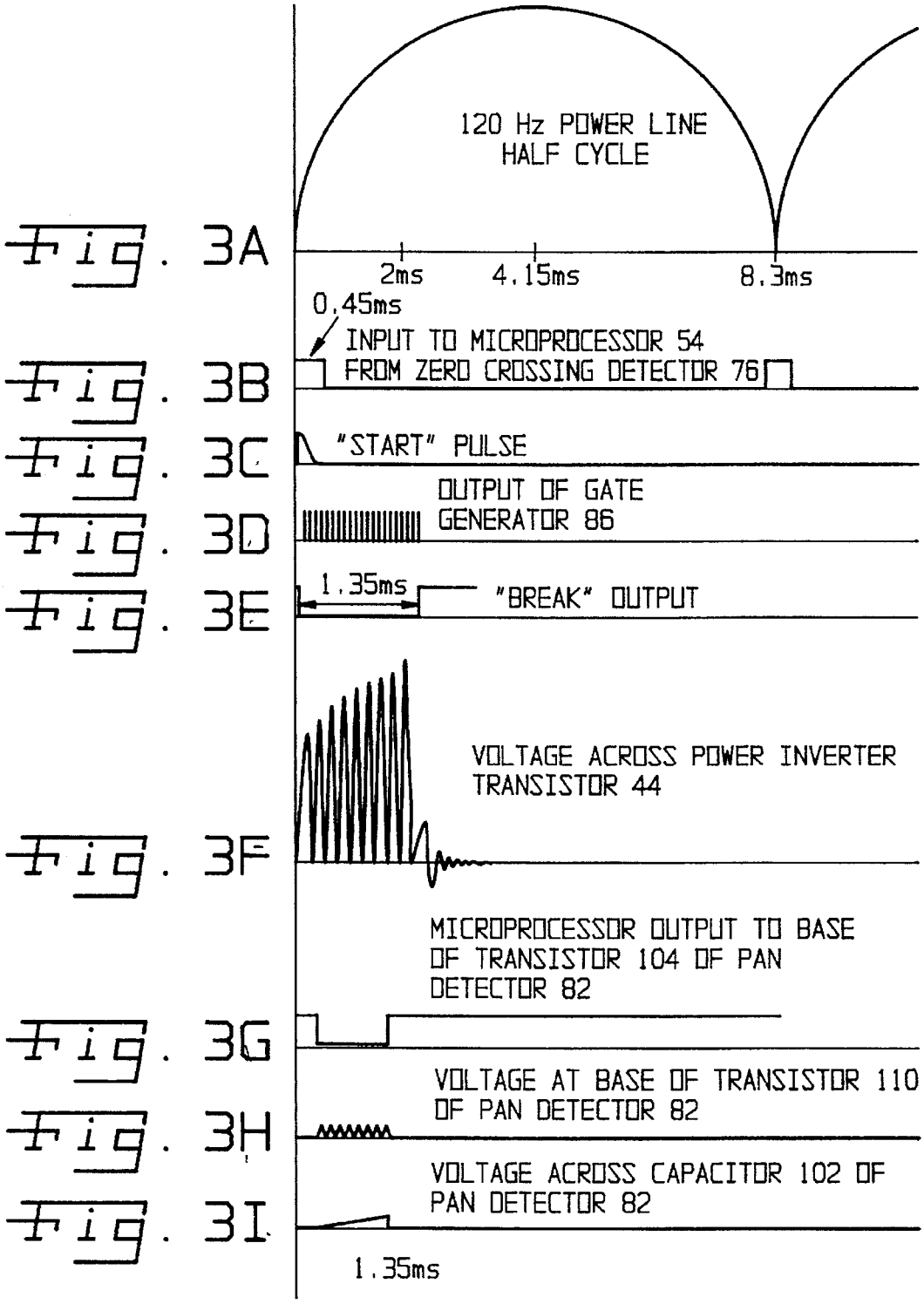
FIGS. 3A–3I form a timing diagram representing the relationship of various signals related to the system shown in FIG. 2.

FIG. 3A shows a waveform of the 120 Hz full wave rectified signal generated by power supply 22.

FIG. 3B shows a waveform of a zero crossing output signal, preferably having a duration of about 0.45 mS, generated by zero crossing detector 76 when the 120 Hz DC signal generated by power supply 22 is at zero volts. The zero crossing signal is supplied to an input of microprocessor 54 via conductor 64.

FIG. 3C shows the "start" and "soft start" signals generated by microprocessor 54 to start power inverter circuit 12. The "soft start" signal is generated by microprocessor 54 during initial start-up following the burner "on" signal from user. After each OFF period associated with the predetermined number of zero crossings corresponding to the selected number of maximum powerline half cycles, a "start" signal is generated by microprocessor 54. Microprocessor 54 supplies the "soft start" pulse via line 59 to command generator 86 to start power inverter circuit 12 at reduced power levels during initial start-up; thereafter microprocessor supplies a "start" pulse via line 58 until operation of the power inverter circuit is interrupted by the microprocessor to gate generator 86 to initiate gate pulse generation. A "pan/no pan" check is performed by microprocessor 54, phase detector 80 and pan detector 82 at the beginning of each powerline half cycle. Since, as shown in FIGS. 3B and 3C, each "start" pulse is synchronized with a zero crossing such that power inverter circuit 12 is only started at a low applied voltage. As explained above, microprocessor 54 interrupts operation of power inverter circuit 12 following the number of powerline half cycles of operation necessary to generate in pan 16 the temperature selected by the user, and microprocessor 54 generates a "start" pulse to restart gate generator 86 every 100 powerline half cycles following the OFF period. This OFF period corresponds to the difference between the 100 powerline half cycles selected in this range to correspond to the maximum allowable cooking temperature and a number of half cycles of uninterrupted power inverter operation corresponding to a desired cooking temperature setting selected by the user via temperature selecting circuitry 70.

Power inverter 12 is operated for at least the 1.35 mS "pan check" period in each powerline half cycle. During the initial "soft start" the power inverter circuit is operated at a reduced power level. FIG. 3D shows a plurality of gating pulses generated by gate generator 86 during the "pan check" time period, which is preferably about 1.35 mS. If after the 1.35 mS "pan check" time it is determined that no pan, or an unacceptable pan, is present adjacent work coil 40, then as shown in FIG. 3E, a "break" signal is generated by microprocessor 54 and is applied over line 60 to actuate break transistor 160. If an acceptable pan is present adjacent the work coil, no break signal is generated by microprocessor 54 and the analog portion 14B of the control continues to generate gating signals for operation of inverter power switching transistor 44 until microprocessor 54 interrupts its operation in controlling pan temperature. (Such continued operation is not illustrated in FIG. 3).

FIG. 3F shows the voltage across power inverter switching transistor 44 from collector to ground during the "pan check" period and after application of the "break" signal generated by microprocessor 54 to stop power inverter circuit 12.

FIGS. 3G–3I shows signals generated by microprocessor 54 and the analog pan detector circuitry 82.

FIG. 3G shows a control output signal generated by microprocessor 54 and supplied to pan detector 82 during the 1.35 mS pan check period. As explained below, the control output signal of FIG. 3G opens a 1.35 mS window for the application of signals from pan detector 82 to microprocessor 54. FIG. 3H shows a pan detector signal generated internally in pan detector 82, and FIG. 3I shows the "no-pan" signal generated internally by pan detector 82. Operation of the pan detector circuitry is described below in conjunction with FIGS. 5 and 6A–H.

Thus, during the 1.35 mS "pan check" period, microprocessor 54, phase detector 80, and pan detector 82 determine whether there is an acceptable pan near work coil 40. If work coil 40 is not inductively loaded to limit the electric current through it to an acceptable level, then operation of the power inverter circuit 12 is interrupted. Thus, acceptable operating conditions of power inverter circuit 12 can be determined at low line voltages so that power inverter circuit 12 can be stopped well before it will be overheated by excessive currents, thereby reducing the possibility of its failure.

Referring to FIG. 2, overheat protector 78 detects any over-temperature of work coil 40 and the adjacent glass top 19 of the range (not shown). If the temperature at the "burner" becomes unacceptably high, a temperature sensor 79 in overheat protector 78 actuates an analog ground signal to immediately short to ground any gate triggering pulses generated by phase detector 80, which would otherwise sustain the operation of power inventer circuit 12, thereby stopping power inverter circuit 12. In addition, overheat protector 78 generates a signal which is supplied via conductor 66 to microprocessor 54. Microprocessor responds by generating an alarm signal which is supplied via conductor 61 to an alarm 162, which in turn generates a "beep" noise and can generate a "break" signal on line 60 to actuate break switching transistor 160, preventing the operation of power switching transistor 44.

Figures 4A, 4B:
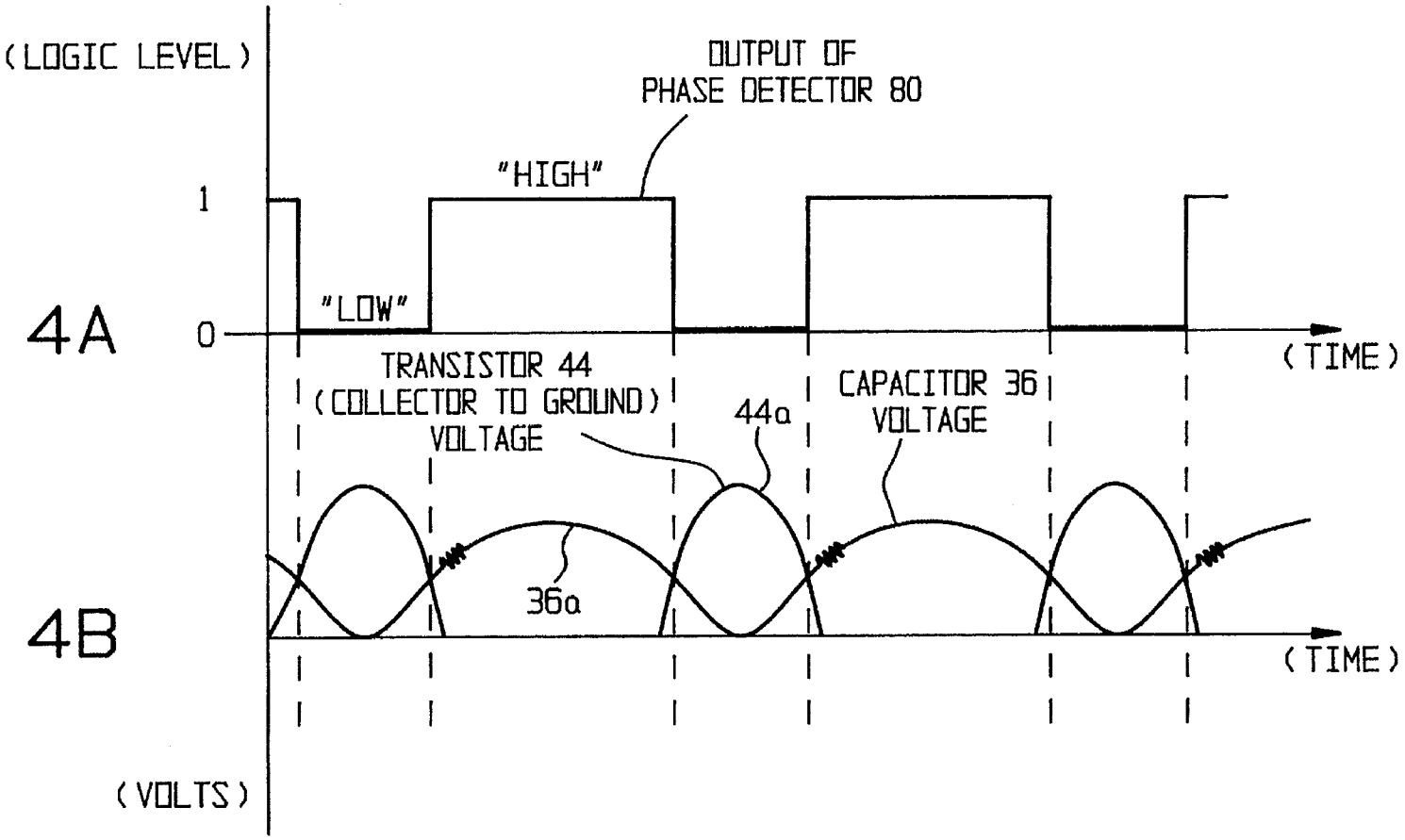
FIGS. 4A–4B show a timing relationship between inputs and an output of the phase detector of the invention.

Phase detector 80 in the analog portion 14B of the control generates the gate triggering pulses to operate gate generator 86, following start-up, and to continue the operation of the power inverter circuit 12 until interrupted by a "break" signal from microprocessor 54. As shown in FIGS. 2, 4A and 4B, phase detector 80 senses voltage phase differences across work coil 40 and capacitor 42 and produces a "high" output signal when the voltage from the collector to ground of power inverter switching transistor 44 is less than the voltage across commutating capacitor 36. As shown in FIG. 4B, the voltage **44*a* across power inverter switching transistor 44 is substantially out of phase with the voltage 36*a* across commutating capacitor 36. As shown in FIGS. 4A and 4B, for example, a logic "low", or "0", output is produced by phase detector 80 when the voltage 44*a* across power inverter transistor 44 is greater than the voltage 36*a* across capacitor 36 and a logic "high" or "1" output as produced when the voltage 36*a* is higher than the voltage 44*a*. Phase detector 80 makes this comparison every inverter cycle and supplies a logic "high", or "1", output via conductor 88 to an input of gate generator 86 to start the next inverter cycle. Gate generator 86 provides a gating signal to driver 48 and power inverter switching transistor 44 for the time that the output of phase detector 80 is "high" and no gating signal to driver 48 and power inverter switching transistor 44 when the phase detector output is low. The output generated by phase detector 80 is thus used by gate generator 86** to determine the duration and termination of each inverter cycle.

The phase comparison made by phase detector 80 is related to whether work coil 40 is loaded or not, i.e. whether an inductive pan is present. A change in the load on work coil 40 will change the inductance of work coil 40, which in turn will change the amount of phase difference between the voltage **36*a* across capacitor 36 and the voltage 44*a* across power inverter transistor 44 (FIG. 4B). Phase detector 80 thus generates a change in the duty cycle of the trigger output signal based upon the loading imposed on work coil 40** by a cooking utensil present at the "burner".

The output of phase detector 80 is also supplied via conductor 57 to microprocessor 54. Microprocessor 54 uses the output phase signal supplied by phase detector 80 to count the inverter cycles in order to develop the "pan check" time period.

The output of phase detector 80 is also supplied via conductor 90 to pan detector 82 where it is used to help determine the presence of an acceptable pan.

Pan detector 82 uses the phase signal received from phase detector 80 to monitor portions of the voltage waveform of commutating capacitor 36 to determine whether an acceptable pan is on work coil 40. Pan detector 82 detects a change in the voltage waveform of commutating capacitor 36 when a pan is introduced near work coil 40 and generates a voltage pulse which is supplied to microprocessor 54 via line 56. Microprocessor 54 checks the status of the signal from pan detector 82 twice during the first 10 μS following a zero crossing signal supplied by zero crossing detector 76.

Figure 5:
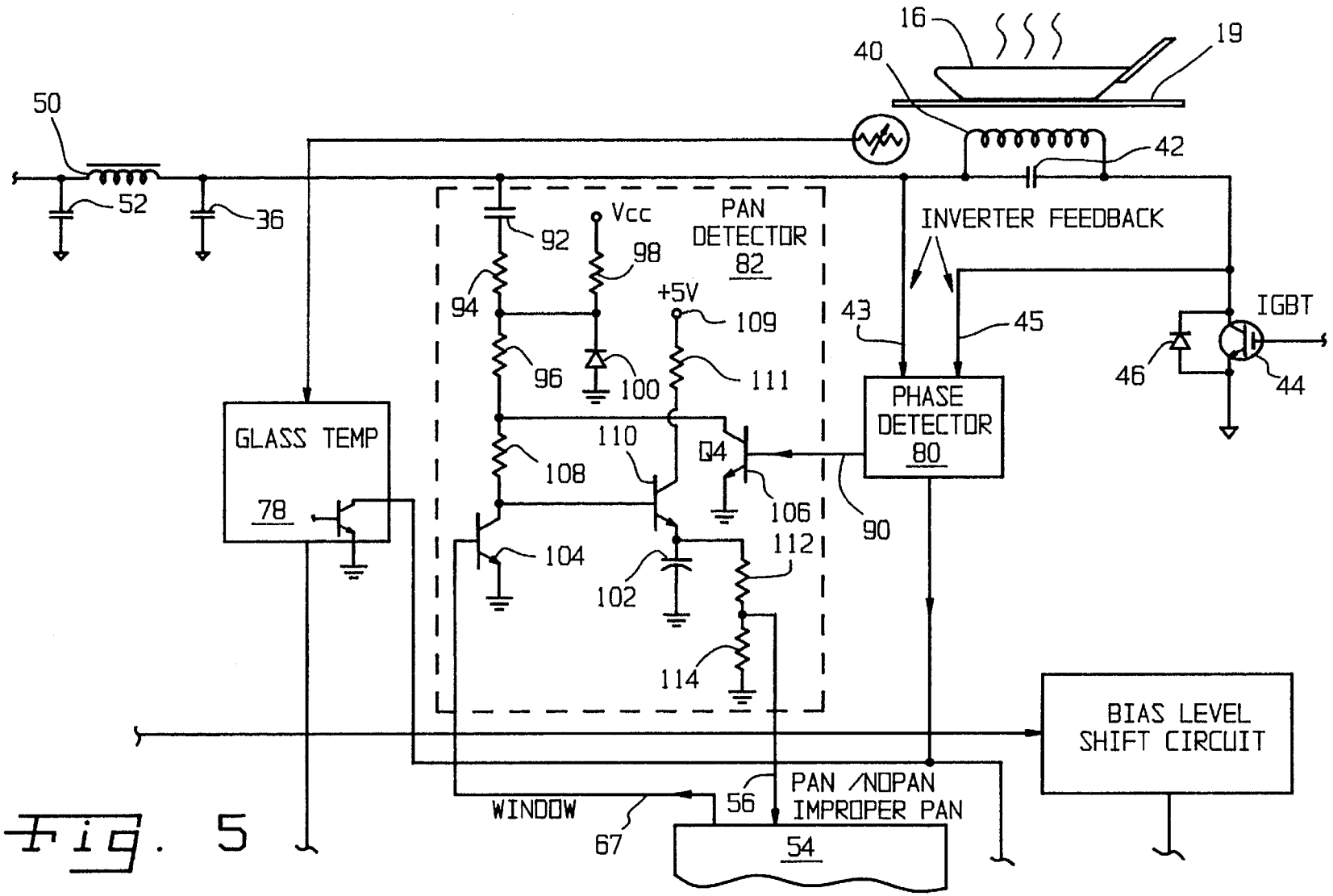
FIG. 5 shows a more detailed portion of FIG. 2 including a schematic diagram of the pan detector of the invention.
Figures 6A, 6B, 6C, 6D, 6E, 6F:
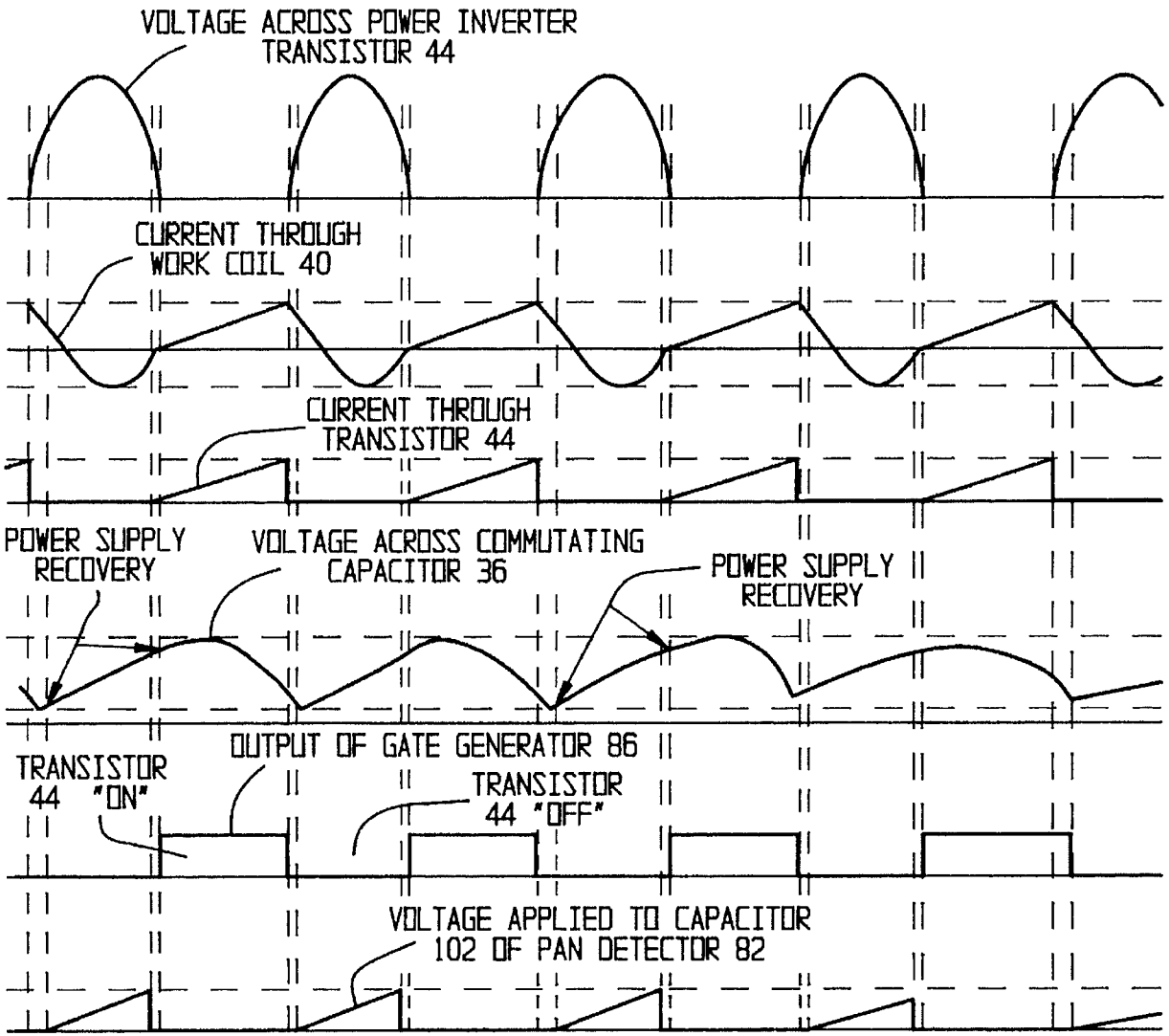
FIGS. 6A–6H form a timing diagram representing the relationship of various signals associated with the operation of the pan detector of the invention.
Figures 6G, 6H:
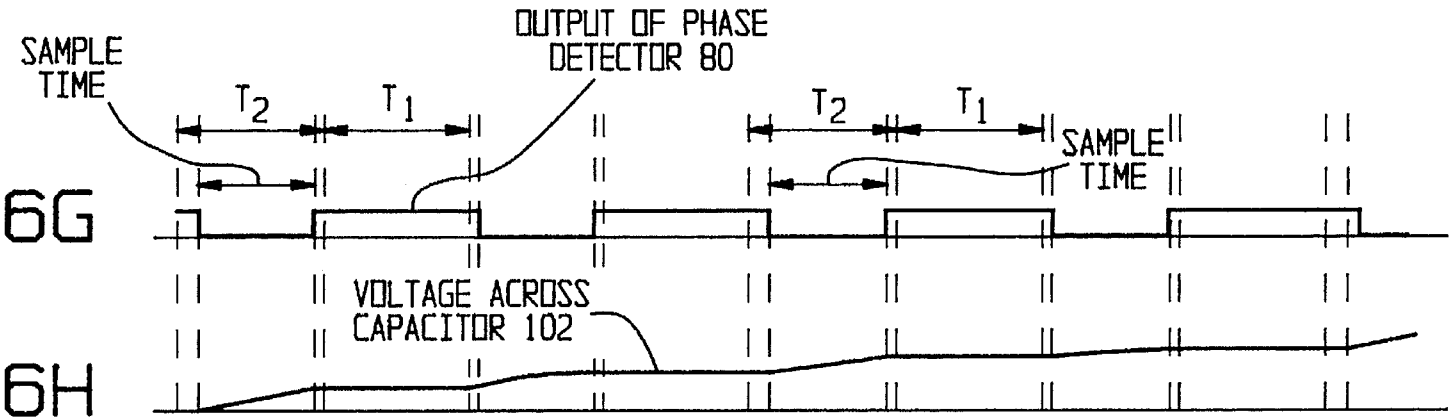

FIG. 5 shows a portion of the block diagram of FIG. 2 and includes a schematic diagram of a preferred pan detector 82 of the invention. A power supply signal from commutating capacitor 36 is coupled to a capacitor 92 of pan detector 82. Resistors 94, 96, and 98, and diode 100 condition the signal from capacitor 36 and reference the signal to ground. As described above, the pan check period of 1.35 mS is determined by a window signal from microprocessor 54 which opens the normally closed transistor switch 104, lifting an effective ground at the junction of resistor 108 and the base of transistor 110 and allowing the voltage at the junction to effect, through transistor 110, the voltage of capacitor 102 only during the pan check period. The charge time of capacitor 102 is further controlled by phase detector 80 and transistor 106 which effectively grounds the signal applied to resistor 108 except when inverter power switching transistor 44 is off (i.e., not conducting) which corresponds to "low" periods shown in FIG. 4A and 6G. Thus, capacitor 102 receives a signal from capacitor 36 only during the "Power Supply Recovery" period of each power inverter cycle during the pan check period. FIGS. 6A–6H form a timing diagram representing the relationship of the various signals relating to the operation of pan detector 82. FIG. 6A shows the voltage across power inverter switching transistor 44 from collector to ground. FIG. 6B shows the current through work coil 40. FIG. 6C shows the current through power inverter transistor 44 from collector to emitter. FIG. 6D shows the voltage across commutating capacitor 36, and the slope thereof labeled as "power supply recovery". FIG. 6E shows the output of gate generator 86 which is used to control the ON and OFF time of power inverter transistor 44. FIG. 6F shows the voltage applied to integrating capacitor 102 of pan detector 82. FIG. 6G shows the output of phase detector 80. FIG. 6H shows the voltage accumulation by capacitor 102 of pan detector 82. Referring to FIGS. 6D–6G, during the "Power Supply Recovery" period, when power inverter transistor 44 is OFF, the voltage slope or charge rate (voltage vs. time) of commutating capacitor 36 (FIG. 6D) is integrated by capacitor 102 (FIGS. 6F, 6H) for the about 27 inverter cycles within the 1.35 mS "pan check" time period. Thus, the charging rates of commutating capacitor 36, which is a function of the loading of work coil 40, results in an average accumulated voltage on capacitor 102 related to the presence or absence of a pan.

As shown in FIGS. 2, 6D and 6E, during the time power inverter transistor 44 is OFF, commutating capacitor 36 charges toward full power supply voltage at a rate influenced by choke 50 and capacitor 52. The LC time constant related to the charge rate of capacitor 36 is referred to as the "Power Supply Recovery". The slope of the waveform associated with the "Power Supply Recovery", in turn, is dependent on the amount of energy absorbed from power supply 22 by power inverter circuit 12 when power inverter switching transistor 44 is ON. As shown in FIGS. 6B and 6E, work coil 40 and parallel capacitor 42 generate a reverse current through work coil 40 and diode 46 during the period in which power inverter switching transistor 44 is OFF, which in turn affects the "power supply recovery" rate. If the amount of energy absorbed by power inverter circuit 12 is large, indicating a pan is on work coil 40, then there is a significant slope associated with the "Power Supply Recovery". If there is no pan on work coil 40, then very little energy is removed from power supply 22, and the slope associated with the "Power Supply Recovery" begins to approach zero. This characteristic is produced every inverter cycle. By monitoring the amount of change in the voltage across capacitor 36 during the "Power Supply Recovery" periods occurring during the 1.35 ms "pan check" period, pan detector 82 determines every 1.35 ms after zero crossing whether there is a proper load (pan) on work coil 40.

As shown in FIG. 5, phase detector 80 is coupled via conductor 90 to transistor 106. Transistor 106, when actuated by phase detector 80 during the time inverter power switching transistor 44 is conducting, shorts the unwanted portion of the voltage waveform of commutating capacitor 36 to ground to prevent capacitor 102 from receiving signals related to the voltage across capacitor 36 during a period when power inverter transistor 44 is ON. As shown in FIG. 6D, 6F and 6H only the desired "Power Supply Recovery" slope characteristic of the voltage across capacitor 36 shown in FIG. 6D is integrated by capacitor 102, and this occurs only when power inverter transistor 44 is OFF. The signal supplied by phase detector 80 and shown in FIGS. 4A and 6G is generated by phase detector 80 about every 0.05 mS based on the comparison of the voltage across capacitor 36 and across power inverter transistor 44, as described above and shown in FIG. 4B.

Referring to FIG. 5, transistor 104 is coupled via control line 67 to microprocessor 54. As shown in FIG. 3G, transistor 104 is used to limit the sampling of the "Power Supply Recovery" slope characteristic of the voltage across capacitor 36 by capacitor 102 to the 1.35 millisecond "pan check" period. Transistor 104 is turned ON by microprocessor 54 at a time other than during the pan check period to prevent unwanted power supply noise from affecting the voltage level of capacitor 102. As shown in FIG. 3G, with reference to FIG. 5, when the window output supplied by microprocessor 54 to transistor 104 is low, transistor 104 is OFF. Thus, the conditioned signal shown in FIG. 3H from capacitor 36 and conditioning resistors 94, 96 and 98, and diode 100 is supplied via resistor 108 to the base of transistor 110, which in turn gates a +5 V power supply 109 coupled to the collector of transistor 110 via resistor 111 to charge capacitor 102 in an amount corresponding to the detected slope information from commutating capacitor 36. Referring to FIGS. 5 and 3G–3I, when transistor 104 is ON, transistor 110 is OFF, at which time capacitor 102 discharges through resistors 112 and 114. Resistors 112 and 114 form a voltage divider from which microprocessor 54, via line 56, senses the amount of voltage charged in capacitor 102 at the end of the 1.35 ms "pan check" period. The voltage threshold value for pan and no pan is compared with programmed values by the microprocessor 54. If the value indicates that no pan is present near work coil 40, then microprocessor 54 stops power inverter circuit 12 before it completes running through the powerline half cycle. If the voltage value indicates that an acceptable pan is on work coil 40, then power inverter circuit 12 is allowed to continue to run until interrupted by microprocessor 54 to control pan temperature.

Figure 7:
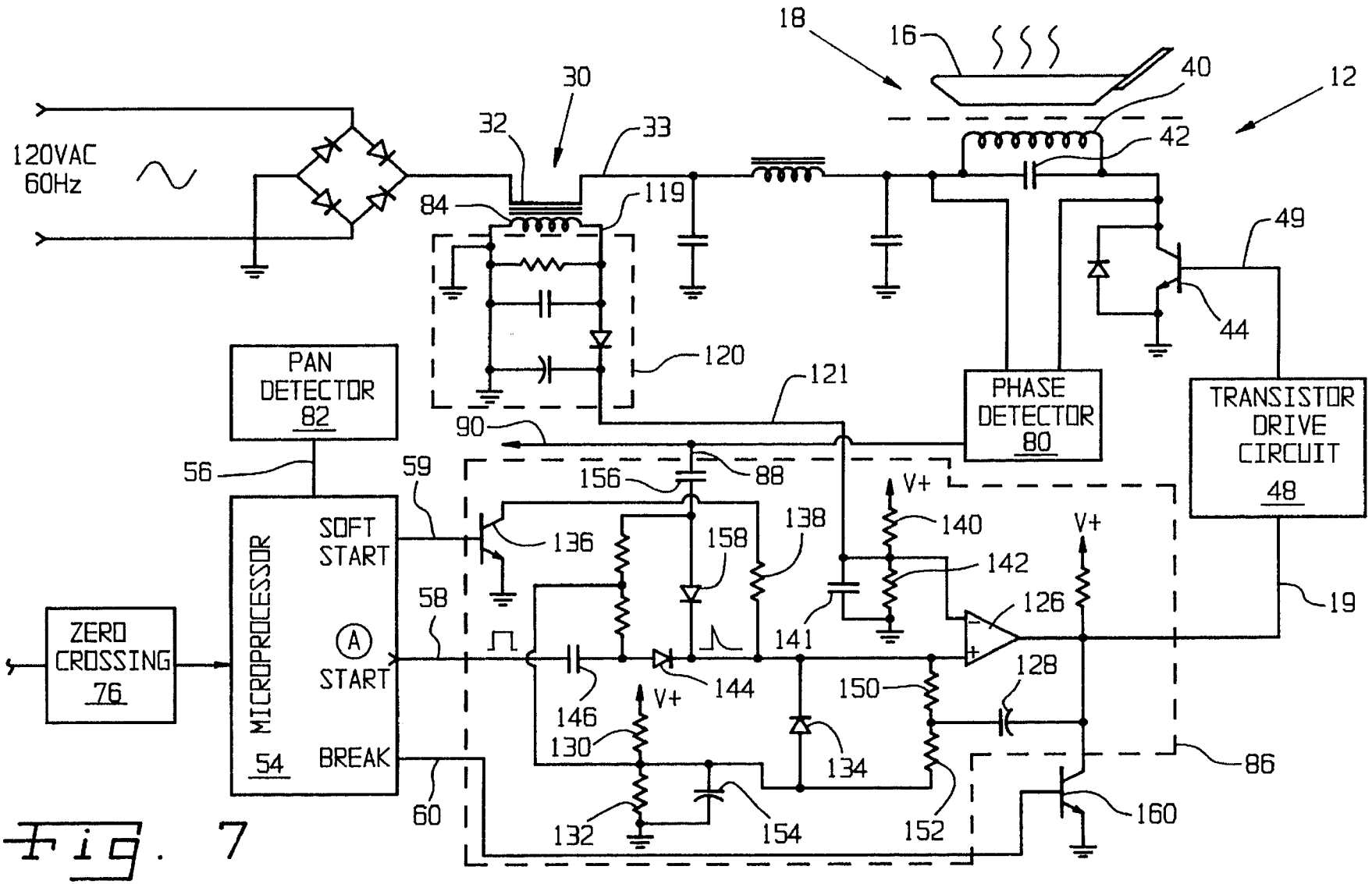
FIG. 7 shows a more detailed portion of FIG. 2 including a schematic diagram of the gate generator of the invention.

Referring to FIG. 7, gating circuit 86 of analog portion 14B generates gating pulses which are supplied to transistor driver circuit 48 for actuating power inverter switching transistor 44 and operating power inverter circuit 12. Gate generator circuit 86 receives "start" and "soft start" signals from microprocessor 54 via conductors 58 and 59, respectively, and receives phase input signals from phase detector 80 via conductor 88, all as described above.

Gate generator 86 also receives an input signal indicative of the material which makes up pan 16. A pan compensation circuit formed by current transformer 30 and a bias level shift circuit 120 provides a pan compensation signal to the gate generator 86 via a conductor 121. Secondary winding 84 of current transformer 30 produces an inverter current output signal in proportion to the current flowing through its primary coil 32 during the operation of power inverter circuit 12. Secondary winding 84 supplies the inverter current output signal via conductor 119 to bias level shift circuit 120. Bias level shift circuit 120 rectifies and filters the inverter current output signal to generate a pan compensation signal which is supplied via conductor 121 to gate generator 86. Gate generator 86 uses the voltage level of the pan compensation signal as an internal voltage reference and varies the duration of its gating pulses to the inverter power switching transistor 44 to compensate for different pan materials.

Figures 8A, 8B, 8C, 8D:
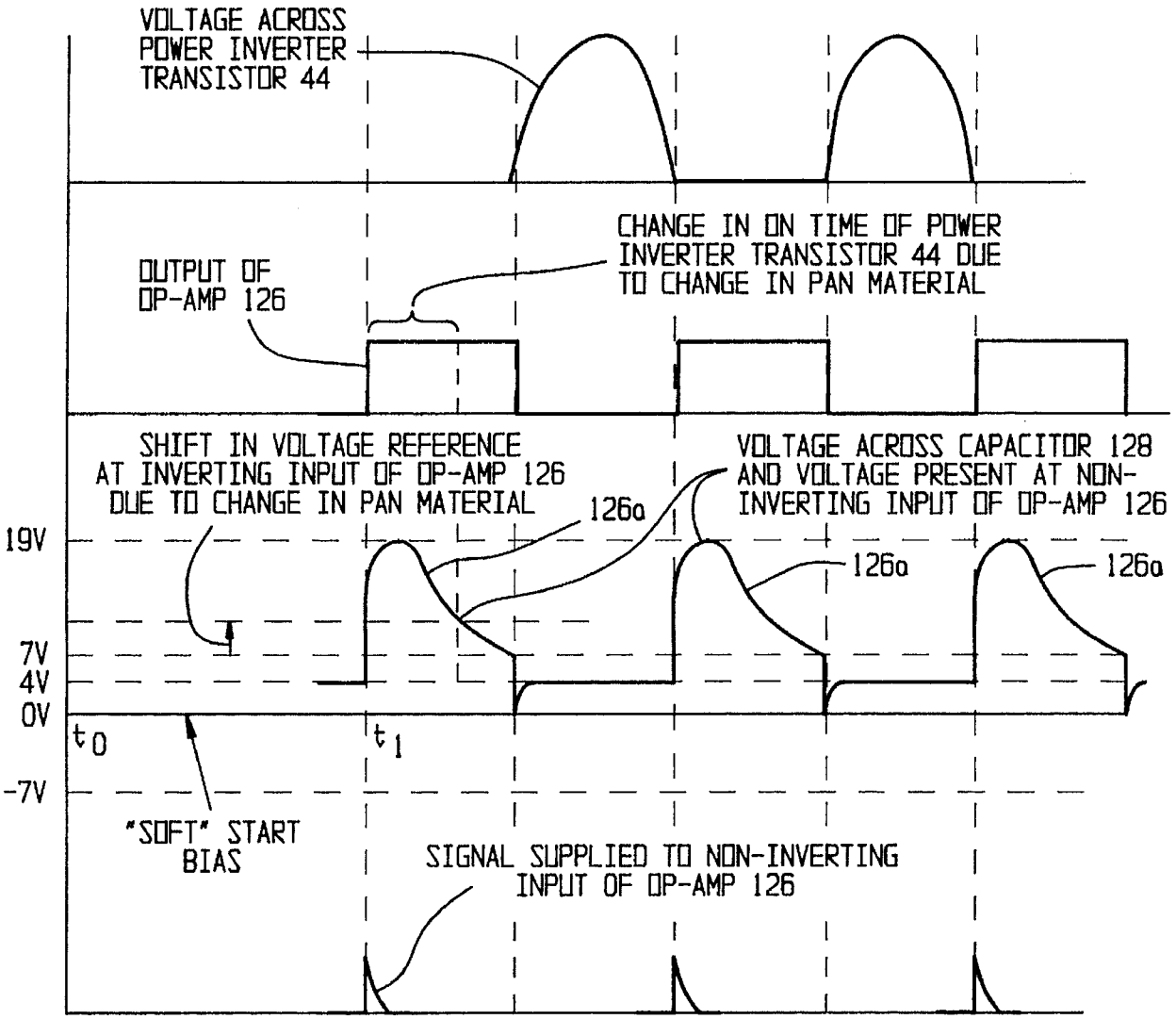
FIGS. 8A–8D show a timing relationship between various signals associated with the operation of the gate generator of the invention.

The operation of gate generator 86 will now be described with reference to FIGS. 2, 3, 7 and 8A–8D. FIG. 7 shows a schematic diagram of gate generator 86. FIG. 8A shows the voltage waveform across power inventer switching transistor 44. FIG. 8B shows the output gating signal generated by an operational amplifier, or op-amp, 126. FIG. 8C shows relative changes in the voltage references supplied to the inverting and non-inverting input of op-amp 126 in relation to the voltage across feedback capacitor 128. FIG. 8D shows a triggering signal supplied to the non-inverting input of op-amp 126 to begin each inversion cycle.

As shown in FIG. 7, gate generator 86 generates a gating signal for power inverter switching transistor 44 with op-amp 126. Op-amp 126 is configured as a comparator/integrator. Initially, when power inverter circuit 12 is OFF, and prior to the generation of the "start" and "soft start" signals by microprocessor 54, the output of op-amp 126 is at a logic "low", and the non-inverting input of op-amp 126 is biased at 4.6 V due to the voltage supplied by a resistor divider network of resistor 130 and resistor 132, through diode 134. Microprocessor 54 supplies a "soft start" signal via line 59 to transistor 136 to switch transistor 136 ON, thereby connecting resistor 138 to ground in parallel with resistor 132 and pulling the non-inverting input of op-amp 126 down to about 4 V, as shown in FIG. 8C.

The inverting input of op-amp 126 is biased at approximately 7 V by the voltage divider made up of resistors 140, 142. Thus, the inverting input to op-amp 126 is initially at a higher voltage potential than the non-inverting input, and the output of op-amp 126 is low, i.e. at zero volts. Thus, the right side of feed back capacitor 128 is coupled to the output of op-amp 126 and is at a potential of 0 volts and the left hand side of capacitor 128 is coupled to the non-inverting input of op-amp 126 and is at a potential of 4 volts.

When a line voltage zero crossing is sensed by the zero crossing detector 76 and logically processed through microprocessor 54, microprocessor 54 generates a "start" pulse output from microprocessor 54. This "start" pulse is supplied to gate generator 86 via conductor 58. The "start" pulse is integrated by capacitor 146 and the positive integration is passed to the non-inverting input of op-amp 126 via diode 144. The "start" pulse is of sufficient amplitude to cause the non-inverting input of op-amp 126 to go more positive than the inverting input of op-amp 126. Referring to FIG. 8B, the output of op-amp 126 then goes 'high' or to V+(15 v) for a period of time which represents the 'on time' for power inverter switching transistor 44.

Referring to FIGS. 7 and 8C, the "high" output of op-amp 126 forces the right side of capacitor 128 to 15 V+. Since the left side of capacitor 128 was at 4 V, it will now be forced to 19 V due to the 15 V shift on the right hand side of capacitor 128. The non-inverting input to op-amp 126 is now at 19 V through resistor 150. The left side of capacitor 128 now discharges through resistors 152 and 132 towards the 4 V bias level. Once the left side of capacitor 128 discharges to a voltage equal to the 7 V reference on the inverting input of op-amp 126, the output of op-amp 126 goes to 'Low' or 0 V. This produces 0 V on the right side of capacitor 128 and the left side of capacitor 128 returns to 4 V.

In order for power inverter circuit 12 to operate at reduced power during the initial turn-on phase, the "soft start" pulse is generated by microprocessor 54 and is supplied via conductor 59 to gate generator 86 during the initial starting of power inverter circuit 12. The "soft start" pulse forces gate generator 86 to deliver a short "on time" signal to power inverter transistor 44, which in turn starts power inverter circuit 12 at low power. The "soft start" pulse places resistor 138 in parallel with resistor 132 through transistor 136. This forces the bias of the non-inverting input to op-amp 126 to approximately 4 volts. This changes the "on time" output by gate generator 86 to a shorter than normal run time, or "on time". Once the soft start pulse is released, gate generator 86 is allowed to increase the "on time" slowly, due to the RC time constant of resistor 130 and capacitor 154. This allows the bias of the non-inverting input of op-amp 126 to slowly approach normal operating bias of 4.6 volts.

In order for gate generator 86 to continue to run, trigger pulses must arrive at the non-inverting input of op-amp 126 continuously after every inverter cycle. After the initial "start" pulse is generated by microprocessor 54, subsequent trigger pulses are delivered to gate generator 86 from phase detector 80. Phase detector 80 supplies feedback signals related to the operation of power inverter circuit 12 to gate generator 86 so as to sustain the operation of power inverter 12. These feedback trigger signals are supplied to the non-inverting input of op-amp 126 through capacitor 156 and diode 158.

Once gate generator 86 is started by microprocessor 54, and as long as the power inverter circuit 12 is running correctly, the phase detector 80 provides feedback trigger signals and gate generator 86 will continue to run. To stop gate generator 86, and subsequently stop power inverter circuit 12, a "break pulse" is supplied by microprocessor 54 via conductor 60 to break transistor 160. Break transistor 160 holds the output of gate generator 86 to a logic low, i.e. 0 V, which stops power inverter switching transistor 44 from receiving gating pulses, stops power inverter circuit 12 from operating and, in turn, and stops phase detector 80 from supplying trigger signals to gate generator 86. Thereafter, gate generator 86 cannot produce gating signals for actuating power inverter switching transistor 44 until a subsequent "start" pulse is generated by microprocessor 54.

The impedance of the LC parallel circuit 18 formed by work coil 40 and capacitor 42 of power inverter circuit 12 substantially depends on the inductive impedance of work coil 40, and the inductive impedance of work coil 40 depends on the magnetic properties of the pan 16 placed near work coil 40 (that is, pan 16 is analogous to an magnetic core for work coil 40). For example, cast iron has a relatively high permeability, and stainless steel has a relatively lower permeability. As a result, a cast iron pan placed near work coil 40 increases the impedance of work coil 40 more than a stainless steel pan placed near work coil 40. Accordingly, the impedance at resonance of work coil 40 increases more due to the presence of a cast iron pan 40 than it would increase due to the presence of a stainless steel pan.

Since the inductive impedance of the work coil 40 changes depending on the type of pan material placed on work coil 40, the amount of energy transferred to pan 16 by work coil 40 varies based upon the pan material. The magnetic permeability of the pan material effects the inductance of the work coil 40 and the strength of the electromagnetic field induced in the pan. The electrical resistivity of the pan material and its magnetic losses effect the electric currents induced in the pan and in the work coil 40. If the amount of current is reduced by an increase in pan and work coil impedance, then the electromagnetic field supplied to pan 16 is reduced. Thus, the amount of energy delivered to pan 16 for heating depends on the type of pan material. Therefore, compensation for the differing pan material is advisable to generate the cooking temperature requested by a user regardless of the various types of pan materials that may be used.

The analog portion 14B of control subsystem 14 includes components for compensating for different pan materials. The pan compensation circuit includes current transformer 30, and bias level shift circuit 120 to provide compensation for pan materials through the operation of gate generator 86. The pan compensation circuit changes the bias voltage level at the inverting input of op-amp 126 to change the gate generator operation time in the same manner that the "soft" start signal from microprocessor 54 changes the voltage bias level at the non-inverting input to op-amp 126. Thus, the pan compensation components control the amount of current used in power inverter circuit 12 by changing the ON time of power inverter switching transistor 44. By making the ON time of power inverter switching transistor 44 shorter, less current will flow through work coil 40. As noted above, the ON and OFF times of power inverter switching transistor 44 are controlled by the gate generator 86. The primary components in gate generator 86 controlling the ON time characteristic are capacitor 128 and resistor 152. The time constant developed by capacitor 128 and resistor 152 sets the basic ON time of power inverter transistor 44. FIG. 8C shows the voltage **126*a* at the non-inverting input of op-amp 126 developed based on the RC time constant of capacitor 128 and resistor 152**.

By changing the voltage reference level at the inverting input of op-amp 126, the duration of the logic "high" developed at the output of op amp 126 and gate generator 86 can be changed, thereby controlling the ON time power inverter transistor 44. As set forth above, the output of op amp 126 changes from a logic high to a logic low when the voltage across capacitor 128 discharges to the voltage reference level of the inventing input of op amp 126. For example, as shown in FIGS. 8B and 8C, a voltage increase of the reference voltage at the inverting input of op-amp 126 above the initial 7 volt level will decrease the ON time generated at the output of op-amp 126 because it will take less time for capacitor 128 to discharge to this higher voltage level, thus the ON time of power inverter switching transistor 44 is reduced. Likewise, a voltage decrease of the reference voltage at the inverting input of op-amp 126 will increase the ON time generated at the output of op-amp 126 and the ON time of the power inverter switching transistor 44.

Current transformer 30 includes a primary 32 which is connected via line 33 to the other components of power inverter circuit 12. Current transformer 30 converts the current passing through primary 32 to a voltage on secondary 84, the higher the current flowing through primary 32 of current transformer 30, the higher the voltage produced on secondary 84 of current transformer 30. The secondary voltage of current transformer 30 is rectified and filtered by bias level shift circuit 120 to generate a DC reference voltage output as a pan compensation signal. The bias reference voltage output (pan compensation signal) is supplied via conductor 121 to the RC circuit formed by resistor 142 and capacitor 141, and to the inverting input of op-amp 126. Thus, the voltage level at the inverting input of op-amp 126 is varied by the amount of current through primary 32 of current transformer 30. An increase in bias reference voltage on the inverting input of op-amp 126 will result in a shorter ON time for power inverter transistor 44. Therefore, as the current increases through the primary of current transformer 30, the ON time of power inverter switching transistor 44 is decreased, and as the current through the primary of current transformer 30 decreases, the ON time of power inverter switching transistor 44 is increased.

Preferably, the initial ON times for op amp 126 of gate generator 86 are set for cast iron as the pan load on work coil 40. This initial setting is made with the component values of capacitor 128 and resistor 152. When stainless steel is placed on the work coil 40, the impedance of work coil 40 decreases relative to the impedance associated with a cast iron pan, and the current supplied to power inverter circuit 12 through the primary of current transformer 30 increases. The bias voltage at the inverting input to op-amp 126 in gate generator 86 is thus increased by the bias level shift circuit 120, and this increase in bias voltage shortens the ON time output of gate generator 86. As a result, the power generated with work coil 40 is reduced and, accordingly, the energy transferred to the stainless steel pan is reduced. The amount of reduction is calibrated so that the stainless steel pan generates the same amount of heat as the cast iron pan.

The software routines executed by microprocessor 54 of system 10 will now be described, as shown in the flow charts set forth in FIGS. 9A–9E, with reference to FIG. 2. When power is first applied to power inverter 12 and control subsystem 14, power supply 22 generates a power on reset signal which is supplied via conductor 65 to microprocessor 54, causing microprocessor 54 to begin executing the main program depicted in FIG. 9A. At step S10, microprocessor 54 senses the "reset" signal from power supply 22 and then, at step S20, initiates a 1 second delay. The 1 second delay at S20 is provided to prevent the initial transients in the power supply voltages from affecting the operation of power inverter 12 or control subsystem 14. After the 1 second delay, microprocessor 54 proceeds to execute step S30 to initiate a "start" cycle in which power inverter 12 is started. After microprocessor 54 starts power inverter 12, the operation of power inverter 12 is sustained by signals from the analog portion 14B of the control system 14, including phase detector 80, gate generator 86, and bias level shift circuit 120. Microprocessor 54 remains at step S30 for at least the time required to perform a check as to whether an acceptable pan 16, i.e. whether a pan made of magnetic material, such as iron, is present adjacent the "burner" location of glass cooktop 19 positioned over work coil 40. Preferably, this "pan check" period is about 1.35 mS. If a proper pan is not present, the microprocessor 54 executes step S40 in which power inverter 12 is stopped. If, however, it is determined that a proper pan is present near work coil 40, then microprocessor 54 remains at step S30 for the remainder of the powerline half-cycle, i.e. about 8.33 mS, and the analog portion 14B, including phase detector 80, gate generator 86, and bias level shift circuit 120 of control subsystem 14 continues to generate gating pulses to continue the operation of power inverter circuit 12 through the remainder of the first powerline half-cycle. Thereafter, microprocessor 54 executes step S50, the cooking cycle, which will continue, with the microprocessor counting powerline half cycles until it is determined that it is time to cycle power inverter 12 OFF to maintain the user-requested cooking temperature in pan 16. After power inverter 12 has been cycled OFF for an appropriate period of time, then microprocessor re-enters step S30 to continue the cooking process. During the cooking cycle of step S50, the analog portion 14B of control subsystem 14 continues to generate gating pulses to sustain the operation of power inverter circuit 12. If during step S50 it is determined that pan 16 has been removed, the microprocessor 54 immediately executes step S40 to stop power inverter 12. If, however, it is determined in step S50 that it is time to cycle OFF power inverter 12, then step S70 is executed.

Figure 9A:
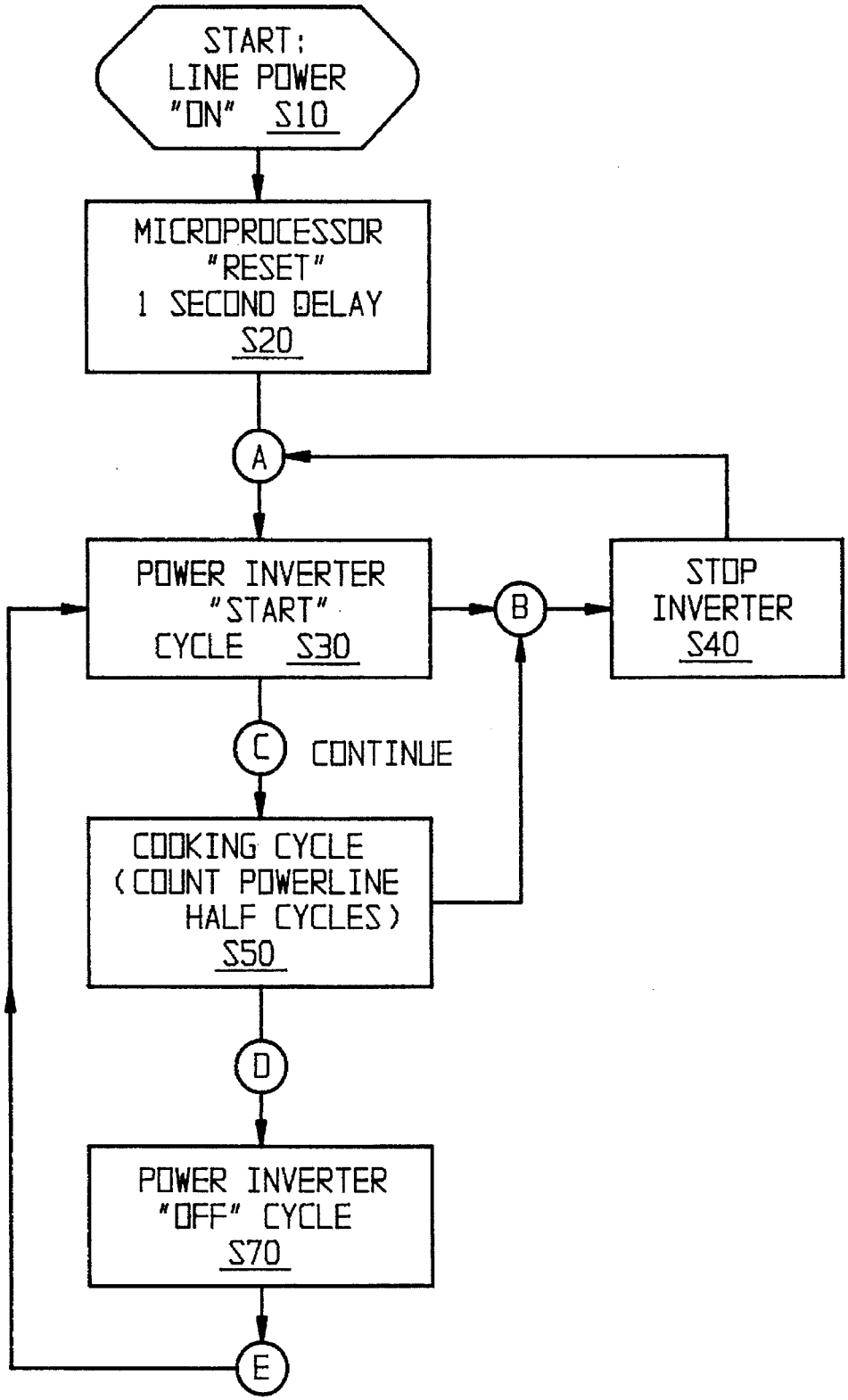
FIGS. 9A–9E show flow diagrams of software routines executed by the microprocessor of the invention.
Figure 9B:
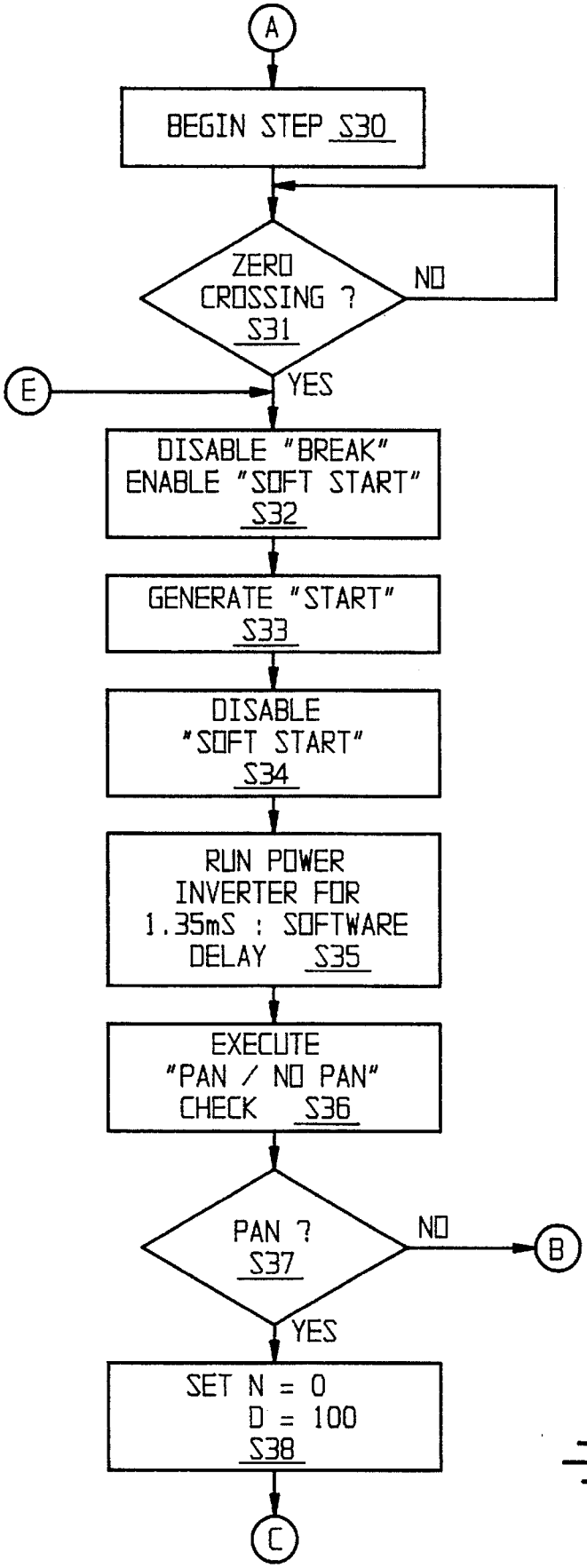

FIG. 9B is a more detailed flow chart of the steps included in step S30. During execution of step S30, at step S31 microprocessor 54 checks for a zero crossing signal supplied via conductor 64 by zero crossing detector 76. Microprocessor 54 then executes step S32 in which microprocessor 54 disables the "break" signal to deactivate break transistor 160, and generates a "soft start" signal which is supplied via conductor 58 to gate generator 86. At step S33, microprocessor 54 generates a "start" signal which is also supplied to gate circuit 86. At step S34, the "soft start" is disabled. After microprocessor 54 generates the "start" pulse, subsequent pulses are generated by analog circuitry, including phase detector 80, gate generator 86, and bias level shift circuit 120. At step 35, microprocessor 54 initiates a gated window, such as 1.35 mS, in which power inverter 12 is allowed to run, and during which pan detector 82 collects voltage data related to whether an acceptable pan is present near work coil 40. At the end of the pan check window period, at step S36 microprocessor 54 reads the output of pan detector 82 via conductor 56. If it is determined at step 37 that no acceptable pan is present near work coil 40, then step S40 is executed to stop power inverter 12 from running. If, however, at step 37 it is determined that an acceptable pan is present, then step S38 is executed at which time a powerline half-cycle counter value, N, is reset to "0", and a memory location stores the value, D, corresponding to the maximum number of powerline half cycles in which power inverter 12 will run without interruption, which accordingly, is associated with the maximum cooking power of system 10. Thereafter, microprocessor 54 proceeds to step S50.

Figure 9C:
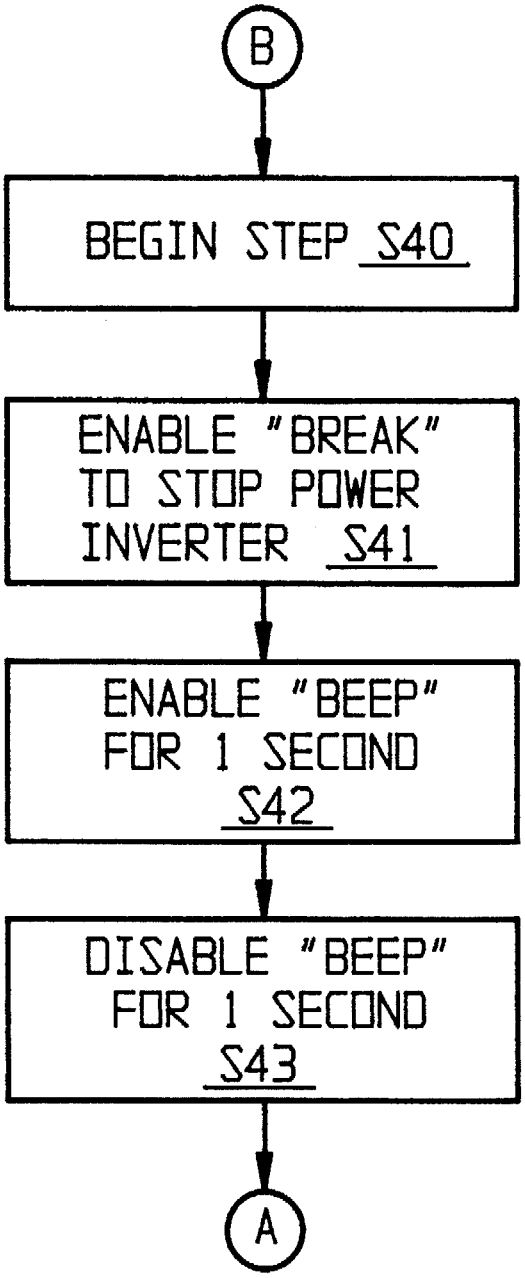

FIG. 9C is a more detailed flow chart of the steps included in step S40. Step S40 may be invoked during the execution of steps S30 or S50 in the event no acceptable pan is present near work coil 40. At step S41, microprocessor 54 generates a "break" signal which is supplied to break transistor 160 via line 60. Microprocessor 54 than generates a "beep" signal for 1 second which is supplied via conductor 61 to an alarm 162. Microprocessor 54 then disables the "beep" signal and delays 1 second prior to resuming program operation at the beginning of step S30 to re-initiate the "start" cycle.

Figure 9D:
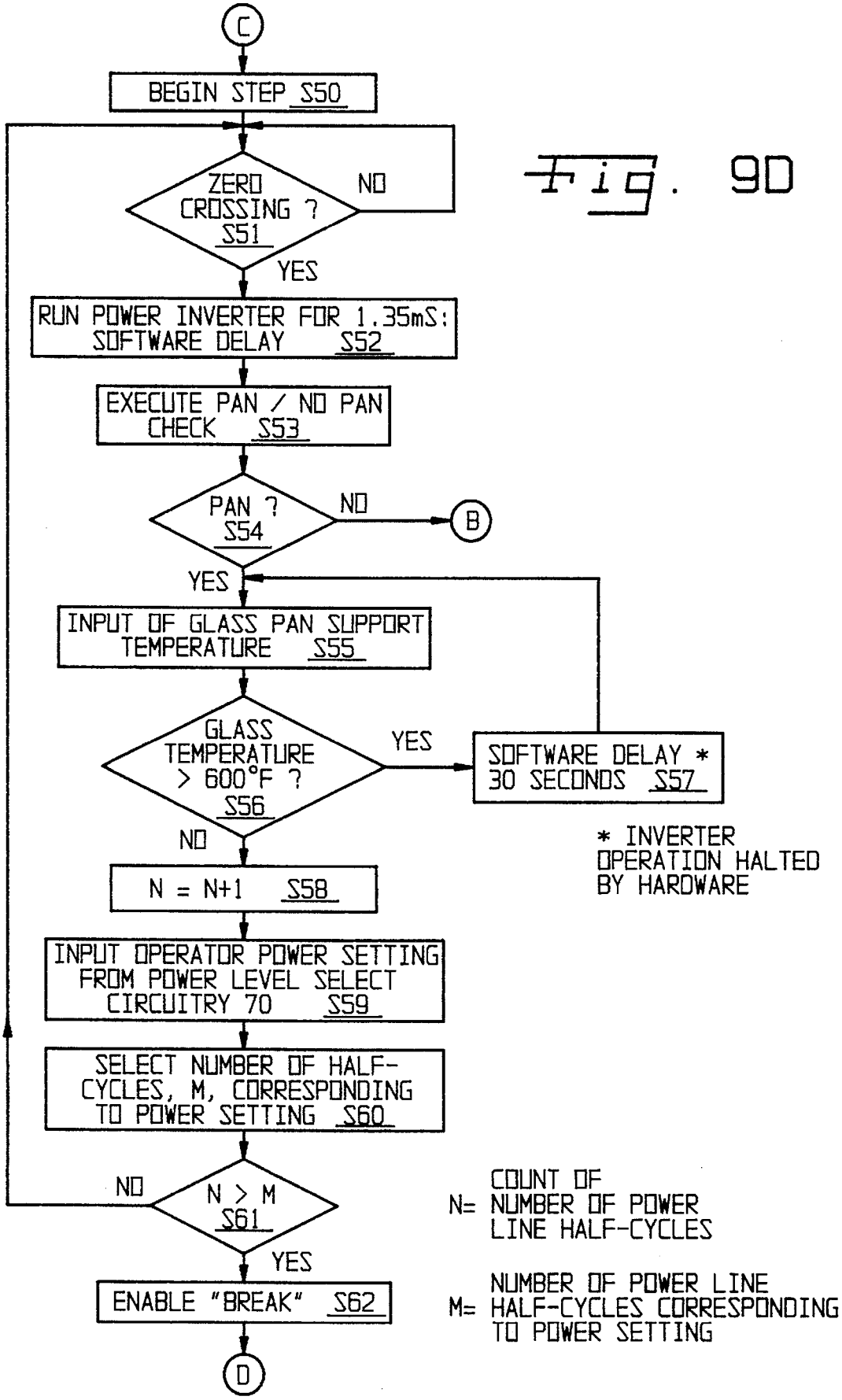

FIG. 9D is a more detailed flow chart of the steps included in step S50. At step S51 it is determined whether a next zero crossing has occurred. At the occurrence of the next zero crossing, steps S52, S53, and S54 are executed, and are the same pan check sequence described above with respect to steps S35, S36, and S37. If it is determined that an acceptable pan is present near work coil 40, then at step S55 microprocessor checks the glass cooktop temperature via a temperature signal received via conductor 66 from over-heat protector 78. If it is determined at step S56 that an over-temperature situation exists, for example, a glass top temperature greater than 600° F., then microprocessor 54 executes a software delay at step S57 for a period of time, such as 30 seconds, and loops back to re-execute step S55 to receive a temperature input. Independent from the operation of microprocessor 54, if an over-temperature situation occurs, the analog circuitry of over-heat protector 78 grounds the output of phase detector 80 to stop operation of the power inverter circuit 12. If the glass temperature is at an acceptable level, at step S58 the contents of the line half-cycle counter, N, is incremented. At step S59, microprocessor 54 checks for an operator input signal supplied by power level select circuitry 70 via line 62. Microprocessor 54 uses the power level setting signal as an index to select at step S60 a value, M, corresponding to the number of powerline half cycles which corresponds to the desired temperature to be generated by the pan 16. At step S61, it is determined whether the actual count of the number of line cycles, N, is greater than the number of powerline half cycles M corresponding to the desired cooking power level. If not, then cooking cycle S50 is re-executed beginning at step S51. If N is equal to or greater than M, then at step S62 microprocessor generates a "break" signal which is supplied via conductor 60 to break transistor 160 to stop inverter 12, and the power inverter OFF cycle is initiated at step S70.

Figure 9E:
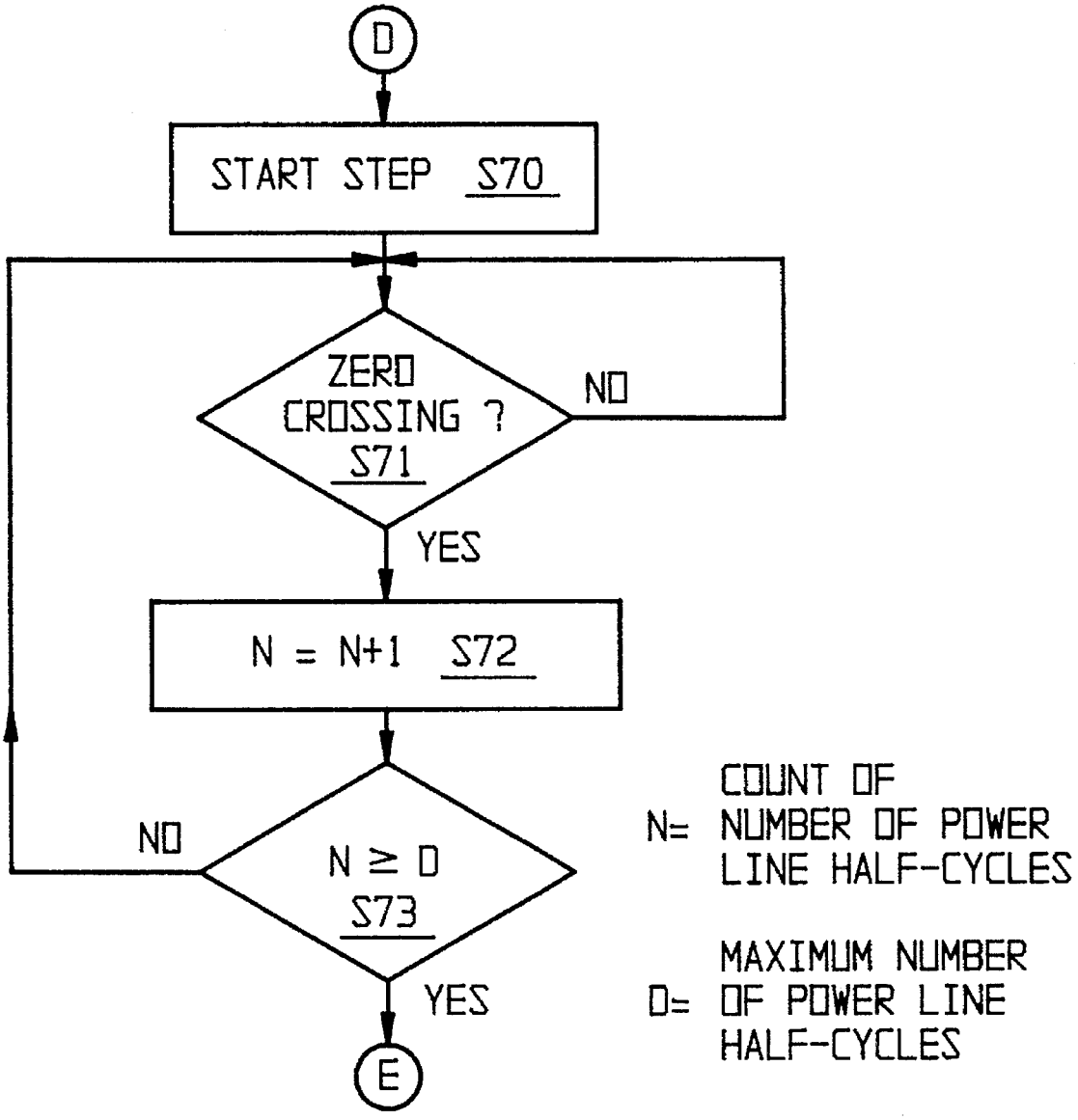

FIG. 9E is a more detailed flow chart of the steps included in step S70. At step S71, it is determined whether there has been a zero crossing indicative of the start of a new powerline half-cycle. If so, at step S72 the contents, N, of the half-cycle counter is incremented. Thereafter, at step S73 it is determined whether the actual count of the number of line cycles, N, is greater than or equal to the previously determined maximum number of powerline half cycles corresponding to the maximum power/cooking level. If N is less than D, then microprocessor 54 remains in the power inverter OFF cycle of step S70. If N is equal to or greater than D, then microprocessor 54 re-executes cooking cycle step S30 beginning at step S32.

The total inverter OFF time of step S70 can be calculated from the formula: $F=t\times(D-M)$, wherein, F is the total inverter OFF time of step S70;

t is the time associated with the duration of a powerline half-cycle, for example 8.33 mS;

D is the maximum number of powerline half cycles which corresponds to the maximum power/cooking temperature of system 10; and M is the selectable number of powerline half cycles associated with the desired cooking temperature.

Figure 10A:
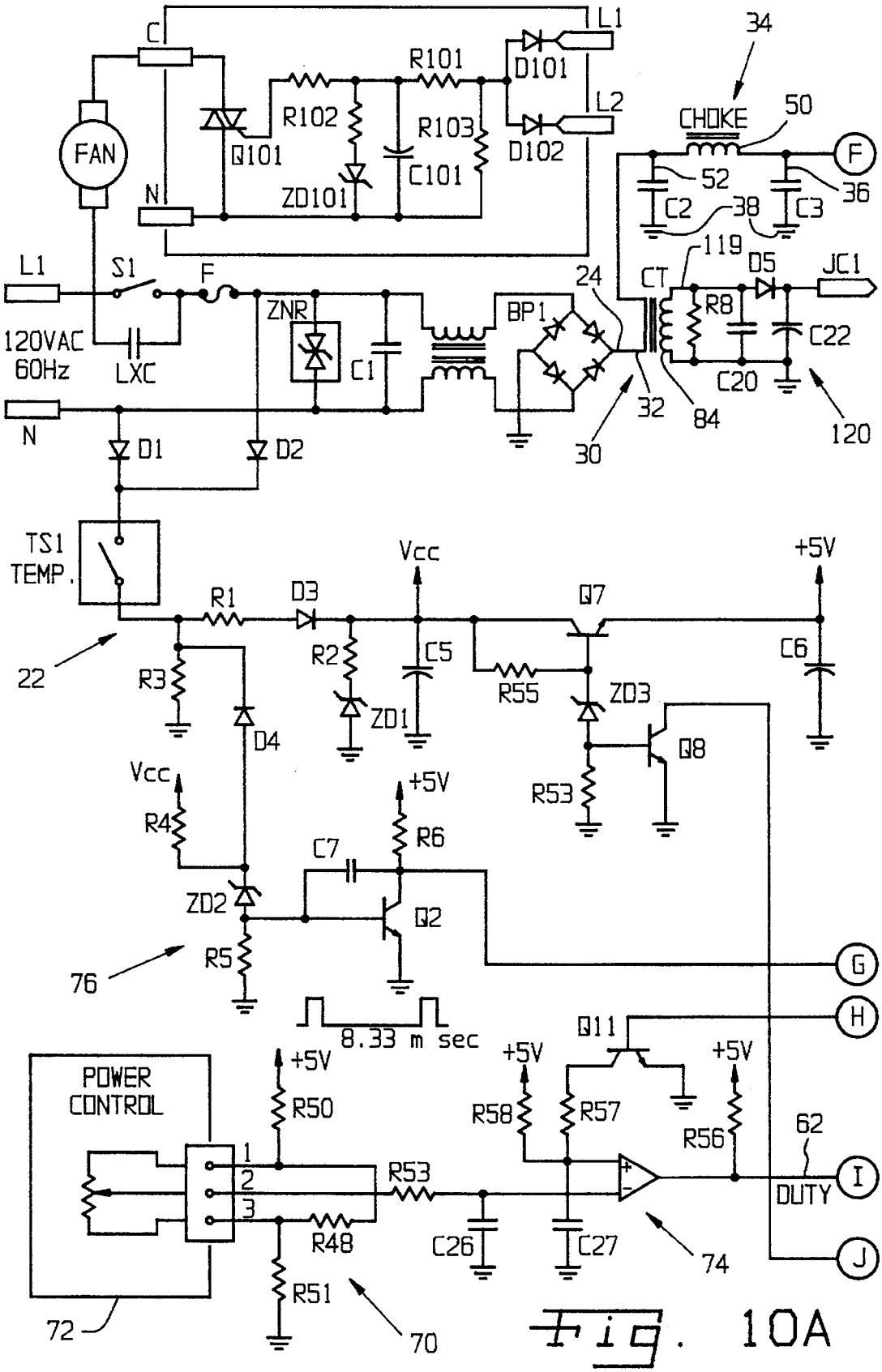
FIGS. 10A, 10B and 10C show a schematic diagram of a preferred embodiment of the inductive cooking system of FIGS. 1–9E. The circuit portions showin in FIG. 10A connect with the circuit portions shown in FIG. 10B at the interconnection points indicated by the encircled F, G, H, I and J at the right side of FIG. 10A and the left side of FIG. 10B, and the circuit portions shown in FIG. 10B further connect with the circuit portions shown in FIG. 10C at the interconnection points indicated by the encircled K, L, M, N and O.
Figure 10B:
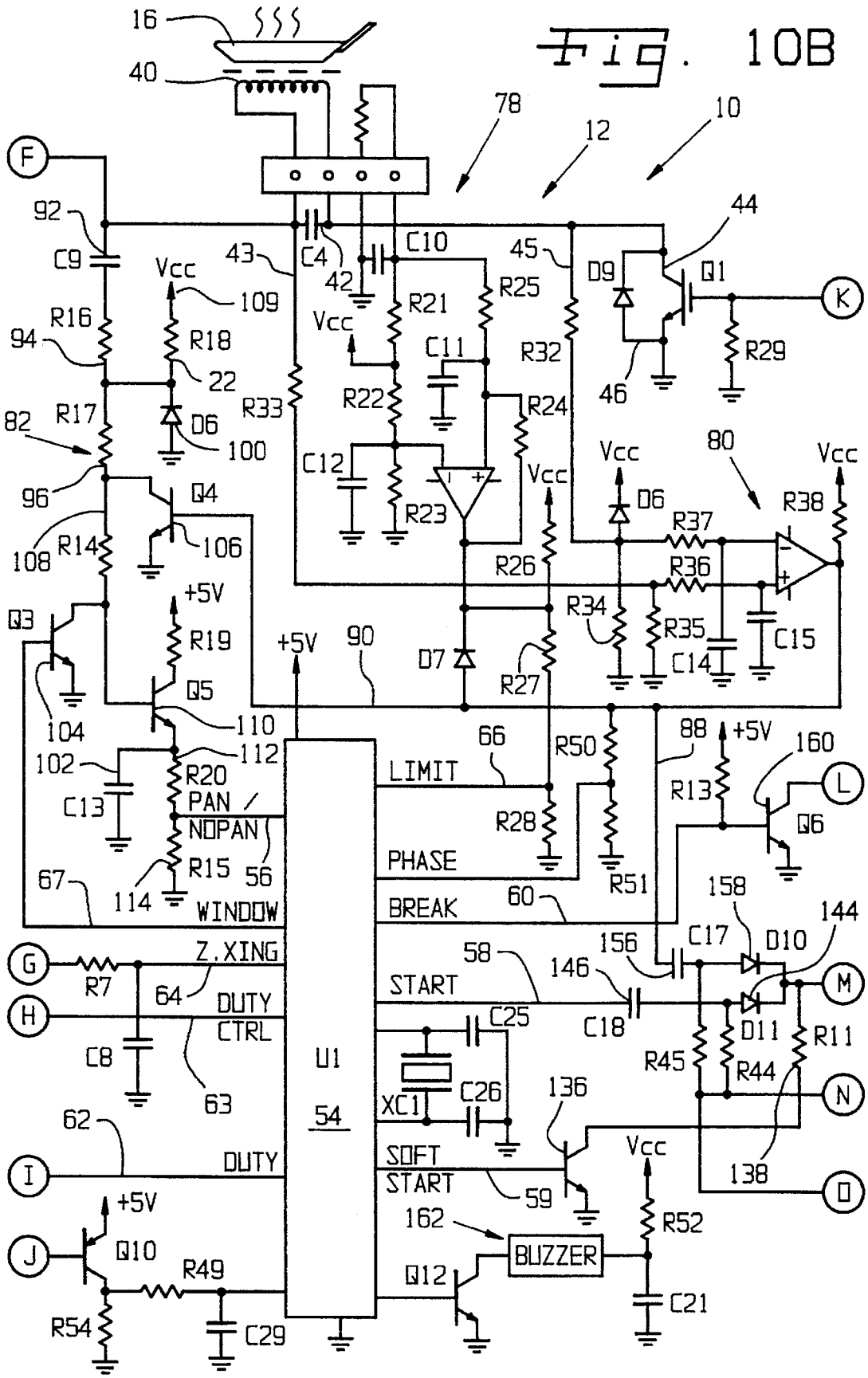
Figure 10C:
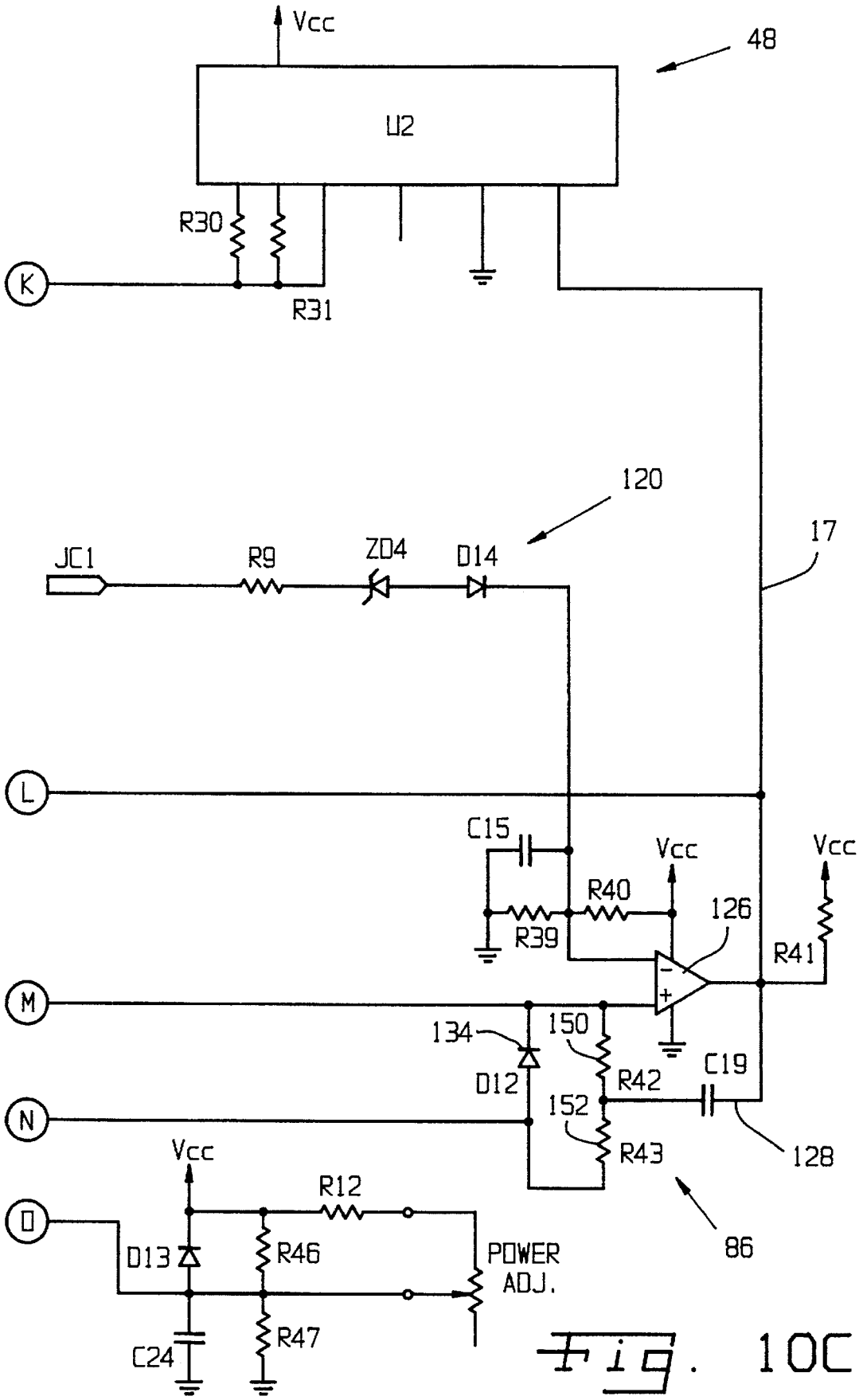

FIGS. 10A, 10B and 10C show a schematic diagram of the inductive cooking system 10 embodying the invention. The operation of the various circuits of inductive system 10 shown in FIGS. 10A–10C operate in a manner consistent with the descriptions given above with respect to FIGS. 1–9E.

The invention provides a new and reliable induction heating system including digital and analog circuitry in which digital circuitry controls starting and stopping of the power inverter, as well as handling user inputs, such as cooking power selections, and in which critical power inverter timing is controlled by analog circuitry which is reliable regardless of powerline voltage.

Although the invention has been described with reference to preferred embodiments, one skilled in the art will recognize that changes may be made in form and in detail without departing from the spirit and scope of the following claims.

What is claimed is:

1. An induction cooking apparatus, comprising:

an electrical power source for providing, from an AC powerline, a DC power signal including a plurality of powerline half cycles;

a power inverter circuit, including an L/C network with a work coil coupled to said DC power signal for inducing heating current in metallic cookware and a switching means for intermittently connecting said L/C network with said DC power signal; and an analog/digital control circuit coupled to said power inverter circuit, said analog/digital circuit including a user input for selecting a cooking temperature to be generated in said cookware, digital means generating a start signal for initiating operation of said power inverter circuit and for generating a stop signal for stopping operation of said power inverter circuit to define a period of operation of said power inverter circuit for generation of said cooking temperature, said digital means being coupled to said user input, and an analog circuit including gate means for generating gating pulses for operation of said power inverter circuit and feedback means coupled with said work coil for generating trigger signals to sustain generation of said gating pulses by said gate means after said power inverter circuit is started by said digital means.

2. The apparatus of claim 1, wherein said switching means comprises an insulated gate bipolar transistor coupled to said work coil to intermittently establish conduction of electrical current of a first polarity through said work coil when said insulated gate bipolar transistor is gated by said gating pulses.

3. The apparatus of claim 1, wherein said digital means generates said start signal to start gating pulse generation by said gate means at a low voltage of said dc power signal.

4. The apparatus of claim 3, wherein said digital means generates said stop signal for stopping said analog circuit from generating said trigger signals.

5. The apparatus of claim 1, wherein a timing of the generation of said trigger signals is based on a voltage phase shift across said work coil.

6. The apparatus of claim 1, wherein said digital means generates an output for adjusting duration of gating pulses during a start-up period for said power inverter circuit.

7. The apparatus of claim 1, wherein said digital means, in response to said user input for selecting a cooking temperature, controls generation of gating pulses for a selected number of powerline half cycles corresponding to a desired cooking temperature.

8. The apparatus of claim 7, wherein said digital means comprises:

counting means for counting powerline half cycles which occur after said power inverter circuit is started, said digital means generating a stop signal to interrupt said generation of said gating pulses when a counted number of powerline half cycles equals or exceeds said selected number of powerline half cycles, and storing means for storing a number of powerline half cycles associated with a maximum cooking temperature generated by said power inverter circuit, said digital means generating a start signal to reinitiate operation of said power inverter circuit after occurrence of said maximum number of powerline half cycles during cooking.

9. The apparatus of claim 1, wherein said digital means comprises a microprocessor.

10. The apparatus of claim 1, wherein said analog/digital circuit further comprises means for detecting the presence of acceptable cookware near said work coil during a first period of a powerline half cycle of said DC power signal.

11. The apparatus of claim 10, wherein said analog circuit generates a pan-no pan signal related to the current through the work coil, said digital means generates a window signal for said pan-no pan signal defining a short portion of each powerline half cycle following its zero voltage crossing as a pan checking period, said analog circuit generating, during said window signal, an input for use by said digital means to generate a stop signal for said power inverter circuit if no acceptable cookware is present.

12. The apparatus of claim 10, wherein said means for detecting the presence of acceptable cookware comprises:

a commutating capacitor coupled between said electrical power source and said work coil, said commutating capacitor generating a voltage related to a recovery time for said commutating capacitor when said switching means is OFF;

means for sampling said voltage corresponding to said recovery time; and a cookware detector circuit including a storage capacitor for accumulating a voltage corresponding to said voltage of said commutating capacitor during a plurality of sampling periods.

13. The apparatus of claim 12, wherein said cookware detector circuit supplies a cookware detector signal to said digital means related to said accumulated voltage, and said digital means compares said cookware detector signal with a predetermined reference value for determining whether acceptable cookware is present near said work coil.

14. The apparatus of claim 1, wherein said feedback means further comprises means for providing varying trigger signal durations to said gate means for generating varying duration gating pulses for operation of said power inverter circuit.

15. The apparatus of claim 14, wherein said means for providing varying trigger signal durations for said gating pulses comprises a phase detector circuit, coupled between said work coil and said gate means, for detecting a voltage phase difference across said work coil and generating trigger signals with durations determined from the voltage phase difference.

16. The apparatus of claim 1, wherein said analog means further comprises means for adjusting a cooking power output of said power inverter circuit to compensate for variation in cookware materials.

17. The apparatus of claim 16, wherein said means for adjusting a cooking power output comprises:

a current transformer having a primary coil and a secondary coil, said primary coil being coupled between said electrical power source and said work coil for sensing the amount of current flowing from said source of electrical power when said switching device of said power inverter circuit is ON; and a level shift circuit coupled to said secondary coil of said current transformer for rectifying and filtering a voltage received from said secondary coil and producing a DC output used by said gate means to increase the ON time of said switching device when a current sensed by said current transformer decreases, and to decrease said ON time of said switching device when said current sensed by said current transformer increases.

18. The apparatus of claim 1, further comprising over-heat protection means for detecting an over-temperature near said work coil.

19. The apparatus of claim 18, wherein said over-heat protection means comprises a transistor for establishing an analog ground to stop said gate means from generating gating pulses upon detection of an over-temperature.

20. The apparatus of claim 1, further comprising a zero crossing circuit for generating a zero crossing pulse at each occurrence of zero voltage during each powerline half cycle, said zero crossing pulses being coupled to said digital means as an input.

21. An induction cooking apparatus having an inverter circuit comprising:

a DC power supply for supplying a plurality of DC power half cycles from an AC powerline;

an inverter circuit having an induction heating coil connected at one end to said DC power supply;

an insulated gate bipolar transistor connected to the other end of said induction heating coil for conducting current of a first polarity through the heating coil;

a diode connected in parallel with said transistor for conducting current of an opposite polarity through said induction heating coil;

a zero crossing detector for generating zero crossing reference signals of the AC powerline;

a microprocessor for supplying an initial inverter start signal to said inverter circuit, said microprocessor receiving said zero reference signals from said zero crossing detector and starting said inverter circuit at a low voltage generated by said DC power supply, selecting a number of powerline half cycles of inverter operation corresponding to a user-desired cooking temperature, and generating signals to interrupt operation of the inverter circuit to obtain the user-desired cooking temperature and to prevent unacceptable operation; and an analog circuit referenced to a voltage of said DC power supply for sensing the presence of cookware made of proper material, and for generating timing signals for sustaining compensated acceptable operation of said inverter circuit after said inverter circuit is started by said microprocessor.

22. The apparatus of claim 21, wherein said analog circuit comprises a phase detector including a phase comparator circuit with one input resistively connected to the collector of the said insulated gate bipolar transistor and the other input resistively connected to the connection between said DC power supply and said induction heating coil, and having an output related to the phase difference produced by the inductance of the induction heating coil during inverter operation for generating said timing signals.

23. The apparatus of claim 22, wherein said analog circuit further comprises a gate generator having a comparator with a first input coupled to an output of said microprocessor and to said output of said phase detector for starting and sustaining operation of said inverter circuit by switching said insulated gate bipolar transistor.

24. The apparatus of claim 23, wherein said analog circuit further comprises:

a current transformer having a primary winding connected in series with said DC power supply, and having a secondary winding;

a rectifier/filter, coupled to said secondary to produce a DC voltage signal related to the amount of current flowing from said DC power supply through said induction heating coil; and a bias control device coupled to said rectifier/filter and to a second input of said gate generator comparator for receiving said DC voltage signal to generate an offset bias voltage at said second input of said gate generator comparator corresponding to an amount of current flowing from said DC power supply through said induction heating coil, said offset bias voltage adjusting operation of said gate generator comparator and conduction time of said insulated gate bipolar transistor to adjust power supplied to said cookware based on a material from which said cookware is made.

25. The apparatus of claim 22, wherein said analog circuit further comprises a pan detection circuit coupled to the output of said DC power supply, said phase detector and said microprocessor, and wherein a commutating capacitor is coupled to the output of said DC power supply, said commutating capacitor generating a voltage related to said recovery time for said DC power supply, and wherein said microprocessor and said phase detector supply signals to said pan detector circuit for selectively sampling said signal related to the recovery time, said pan detector circuit including a storage capacitor for accumulating a voltage corresponding to the voltage of said commutating capacitor during a plurality of sampling periods, said pan detector circuit supplying said accumulated voltage as a pan detector output to said microprocessor, and said microprocessor comparing said pan detector output to a predetermined reference value for determining whether acceptable cookware is present near said induction heating coil.

26. The apparatus of claim 21, wherein said analog circuit further comprises a pan detection circuit connected between said inverter circuit and said DC power supply, and connected to said microprocessor, for generating a signal corresponding to a recovery time for said DC power supply during a period of non-conduction of said insulated gate bipolar transistor.

27. A method for heating metallic cookware with a work coil of an inductive heating device, comprising the steps of:

generating a plurality of gating pulses for operating a power inverter circuit wherein a start pulse is generated by digital circuitry and subsequent pulses are generated by analog circuitry;

starting said power inverter circuit at substantially zero applied voltages of powerline half cycles;

adjusting pulse durations of a plurality of gating pulses during a start period to start said power inverter circuit at reduced power;

determining during an initial portion of each powerline half cycle whether acceptable cookware is positioned near said work coil, wherein if after said first initial portion it is determined that acceptable cookware is present, then said power inverter circuit is operated through a remainder of said half cycle, and wherein if at the end of said first initial portion it is determined that no acceptable cookware is present, then said power inverter is commanded by said digital circuitry to stop; and adjusting pulse durations of said gating pulses supplied to said power inverter to compensate for cookware materials other than that of a predetermined standard for said cookware material.

28. The method of claim 27, wherein during said initial portion of each powerline half cycle, a signal for determining the absence of acceptable cookware is generated during a plurality of power inverter cycles during the periods when said gating pulses are absent.

29. The method of claim 27, further comprising the step of selecting a number of powerline half cycles of operation of the power inverter circuit corresponding to a desired cookware temperature during which said power inverter circuit will run uninterrupted.

30. The method of claim 29, further comprising the step of interrupting said generation of said gating pulses by said analog circuitry when an actual number of powerline half cycles is greater than a selected number of powerline half cycles to temporarily stop said power inverter circuit.

31. The method of claim 30, further comprising the step of restarting said power inverter circuit following a predetermined number of powerline half cycles corresponding to a maximum cookware temperature.

32. In a cooking range having an induction heating burner connectable to any AC powerline including an inverter circuit for induction heating of a cooking utensil, and having a control circuit providing a range user with control of the induction burner, including the temperature generated by the cooking utensil, the improvement comprising:

a digital control portion in communication with the range user providing a signal to start the inverter circuit with an initially reduced power output, a signal to interrupt operation of the inverter circuit in response to the absence of acceptable cookware at the burner, and signals to interrupt operation of the inverter circuit for variable intermittent times to control the temperature generated by the cookware and thereafter restart the inverter circuit during cooking, and an analog control portion generating triggering signals for continuous operation of the inverter circuit once started and in the absence of said interrupting signals from the digital control portion, and signals to compensate for cookware made of materials with differing electromagnetic properties during cooking and to interrupt, through said digital control portion, operation of said inverter circuit if no acceptable cookware is present at the burner.

33. The cooking range of claim 32 wherein the digital control portion comprises a programmed microprocessor having as inputs:

a signal generated at each zero voltage occurrence by the AC powerline, a signal related to the user-selected cookware temperature, a signal from said analog circuit portion indicating the absence of acceptable cookware, and a signal at each cycle of operation of said inverter circuit, said microprocessor providing in response thereto:

a soft start output for initiating operation of said inverter circuit by said analog circuit at reduced power, a window signal for a small initial portion of each powerline half cycle to permit application of the analog circuit signal if no acceptable cookware is present at the burner assembly, break signals to interrupt operation of the inverter circuit following a programmed number of powerline half cycles corresponding to the user-selected cookware temperature and to interrupt operation of the inverter circuit at any time acceptable cookware is not present at the burner, and start signals to restart the inverter circuit, after its interruption at said programmed number of powerline half cycles corresponding to the user-selected cookware temperature, at a number of powerline half cycles corresponding to a maximum user-selectable temperature;

said analog circuit portion comprising, a generator for gating pulses for operation of the inverter circuit, a detector circuit connected with the inverter circuit for generation of triggering signals for said generation of gating pulses, a compensator circuit coupled with the inverter circuit and providing a compensator signal to said generator for gating pulses that adjust a gating pulse duration for differing cookware materials, and a switch across the output of the generator for gating pulses to interrupt operation of the inverter circuit in response to outputs of said microprocessor.

34. The cooking range of claim 32 further comprising an over temperature sensor adjacent the burner and an overheat detection circuit to remove application of said triggering pulses from said generator for gating pulses and terminate operation of the inverter circuit in the event of burner overheating.

35. The cooking range of claim 34 wherein said overheat detection circuit provides an input to the microprocessor, said microprocessor generating a warning signal to warn the range user.

36. In an induction cooking apparatus, comprising a DC voltage source of a filtered plurality of AC powerline half cycles, a power inverter including an induction heating coil, a semiconductor switch providing, upon operation, an electric current path from said DC voltage source through said induction heating coil, and a control for switching said semiconductor switch ON and OFF to provide induction heating of cookware adjacent said induction heating coil, the improvement comprising a capacitor connected across said DC voltage source at the input of the induction heating coil, a pan-present circuit connected with said capacitor and generating a no pan voltage from the voltage of said capacitor including first window means for said no pan voltage permitting generation of said no pan voltage for only a small initial portion of each powerline half cycle following each zero voltage event, second window means permitting generation of said no pan voltage only during the OFF periods of said semiconductor switch, and an integrator to accumulate said no pan voltage only during a plurality of semiconductor switch OFF periods in the small initial portions of each powerline half cycle, said no pan voltage being thereby generated from recovery of said DC voltage source from electric current through the inductor heating coil and being applied to said control to interrupt operation of said semiconductor switch.

37. In an induction cooking apparatus including a DC power supply, a power inverter circuit including an induction heating coil and a switching circuit for providing electric current pulses from said DC power supply through said induction heating coil, and a control for operating said switching circuit and generating with said induction heating coil an induction heating field, the improvement wherein said switching circuit for said induction heating coil comprises an insulated gate bipolar transistor, and said control comprises analog circuitry connected with said induction heating coil to generate, once started, operating signals of variable duration for said insulated gate bipolar transistor based on the phase of a voltage of the induction heating coil.

38. The apparatus of claim 37, wherein said analog circuitry comprises a phase comparator having one input connected with one end of the induction heating coil and the other input connected with the other end of the induction heating coil to provide an output only when said one end is at a voltage less than said other end, said output providing a variable duration operating signal for controlling said insulated gate bipolar transistor.

39. The apparatus of claim 37, further comprising a temperature sensor located adjacent said induction heating coil for providing, in the event of unacceptable temperatures, an output to interrupt the operating signals of said analog circuitry to stop operation of the induction heating coil.

40. The apparatus of claim 37, further comprising a pan detection circuit for determining the presence of acceptable cookware adjacent the induction heating coil from the recharging rate of the DC power supply and wherein the operation signals of the analog circuitry gates the pan detection circuit so that it only receives recharging rate signals.

41. A method for heating metallic cookware using an interrupted flow of electric current through an inductive work coil, comprising providing a signal to start the interrupted flow of electric current through said inductive work coil by the application of DC voltage pulses to the inductive work coil during a working period;

developing phase differences of voltage across the induction work coil resulting from the interrupted flow of electric current, developing trigger signals from the phase differences of voltage across the induction work coil and generating therefrom electric current gating signals controlling the interrupted flow of electric current through the inductive work coil, said electric current gating signals providing a continuous interrupted flow of electric current through said inductive work coil so long as the DC voltage pulses are applied until a stop signal is provided.

42. The method of claim 41 further comprising the steps of generating a zero crossing signal upon the initial voltage rise of each DC voltage pulse and using said zero crossing signal for starting the flow of electric current through said inductive work coil during each DC voltage pulse.

43. The method of claim 41 further comprising the step of counting the number of trigger signals and developing a pan check period during an initial portion of each DC voltage pulse.

44. The method of claim 43 further comprising the step of developing a pan check signal from the DC voltages of said DC voltage pulses during the pan check period and using the pan check signal to remove the application of the DC voltage pulse in the absence of an acceptable cookware.

45. The method of claim 41 further comprising controlling the number of DC voltage pulses applied to the inductive work coil to control the heating of the metallic cookware.

46. The method of claim 45 further comprising the steps of selecting a maximum member of DC voltage pulses for generation of a maximum cooking temperature, and repetitively applying no more than the maximum number of DC voltage pulses to the inductive work coil during the working period.

47. The method of claim 46 further comprising the steps of selecting a cooking temperature for the metallic cookware, selecting a corresponding number of DC voltage pulses, less than said maximum number of DC voltage pulses corresponding to said maximum temperature, to generate said selected cooking temperature, and repetitively applying said corresponding number of DC voltage pulses to said inductive work coil during the working period.

48. The method of claim 41 further comprising the steps of generating a compensation signal from the current flowing through the inductive work coil during the application of the DC voltage pulses, and using said compensation signal to control the current through the inductive work coil and compensate for differences in the metallic cookware.

49. The method of claim 48 further comprising the step of using said compensation signal to vary the duration of said electric current gating signals.

* * * * *